US009511893B2

(12) United States Patent
Schewe et al.

(10) Patent No.: US 9,511,893 B2
(45) Date of Patent: Dec. 6, 2016

(54) GIFT CARD APPARATUS AND METHODS OF MANUFACTURING THE SAME

(71) Applicant: R.R. Donnelley & Sons Company, Chicago, IL (US)

(72) Inventors: Joseph Kurt Schewe, Glen Ellyn, IL (US); Brian R. Techter, Montgomery, IL (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 113 days.

(21) Appl. No.: 14/171,408

(22) Filed: Feb. 3, 2014

(65) Prior Publication Data

US 2014/0217159 A1 Aug. 7, 2014

Related U.S. Application Data

(60) Provisional application No. 61/760,438, filed on Feb. 4, 2013.

(51) Int. Cl.

| | |
|---|---|
| ***B65D 5/00*** | (2006.01) |
| ***B65D 5/24*** | (2006.01) |
| ***B65D 5/42*** | (2006.01) |

(52) U.S. Cl.

CPC ..... *B65D 5/24* (2013.01); *B65D 5/4208* (2013.01); *B65D 5/4225* (2013.01)

(58) Field of Classification Search

CPC ..... B65D 5/00; B65D 5/10; B65D 5/20; B65D 27/22; B65D 5/3657; B65D 5/5011; B65D 5/24; B65D 5/4208; B65D 5/4225

USPC ..... 206/449, 762; 229/117.19, 126, 117.08, 229/145, 172, 186

See application file for complete search history.

(56) References Cited

U.S. PATENT DOCUMENTS

| | | | | |
|---|---|---|---|---|
| 2,531,507 | A * | 11/1950 | Goodyear | B65D 5/3642 229/117.04 |
| 2,544,565 | A * | 3/1951 | Phillips | B65D 5/3607 229/117.07 |
| 6,971,524 | B1 * | 12/2005 | Voswinkel | B65D 5/10 206/232 |
| 7,681,782 | B2 * | 3/2010 | Bondarik | B65D 5/36 229/117.07 |
| 8,615,910 | B2 * | 12/2013 | Glass | G09F 1/04 206/449 |
| 8,875,886 | B2 * | 11/2014 | Brill | B65D 73/0028 206/461 |
| 2003/0150142 | A1 * | 8/2003 | Street | B42D 15/045 40/124.11 |
| 2004/0140345 | A1 * | 7/2004 | Kao | B65D 5/3657 229/117.07 |
| 2013/0161214 | A1 * | 6/2013 | Nebeker | B65D 5/3657 206/307 |

OTHER PUBLICATIONS

Uline, "Gift Card Boxes", retrieved on Apr. 4, 2016, [http://www.uline.com/BL_5639/Gift-Card-Boxes], 1 page.

(Continued)

*Primary Examiner* — Chun Cheung

(74) *Attorney, Agent, or Firm* — Hanley, Flight & Zimmerman, LLC

(57) ABSTRACT

Gift card apparatus and methods of producing the same are disclosed. An example apparatus includes a substrate including a first panel and a self-erecting box having a lid, a first line of weakness defined by substrate to separate the first panel from the self-erecting box, the first panel to be folded about the first line of weakness to position a first surface of the first panel immediately adjacent the self-erecting box, a card to be coupled to a second side of the panel.

9 Claims, 39 Drawing Sheets

(56) References Cited

OTHER PUBLICATIONS

Ezcardline, Gift Cards and a Variety of Gift Card Carriers, retrieved on Apr. 4, 2016, [http://www.ezcardline.com/gift-cards-carriers.aspx], 1 page.

Gift Card Printer Online, "Gift Card Accessories", retrieved on Apr. 4, 2016, [https://web.archive.org/web/20150211140553/http://giftcardprinteronline.com/gift_cards_accessories.html], 5 pages.

Gift Magic, "The Original Gift Card Box", retrieved on Apr. 4, 2016, [https://web.archive.org/web/20101126082739/http://boxywrap.com/], 2 pages.

* cited by examiner

GIFT CARD APPARATUS AND METHODS OF MANUFACTURING THE SAME

RELATED APPLICATION

This patent claims priority to U.S. Provisional Application No. 61/760,438, filed Feb. 4, 2013, which is hereby incorporated herein by reference in its entirety.

FIELD OF THE DISCLOSURE

This patent relates to gift card apparatus and, more specifically, to gift card apparatus and methods of producing the same.

BACKGROUND

Gift cards can be used as an alternative to monetary and/or non-monetary gifts.

DETAILED DESCRIPTION

Figure 1:
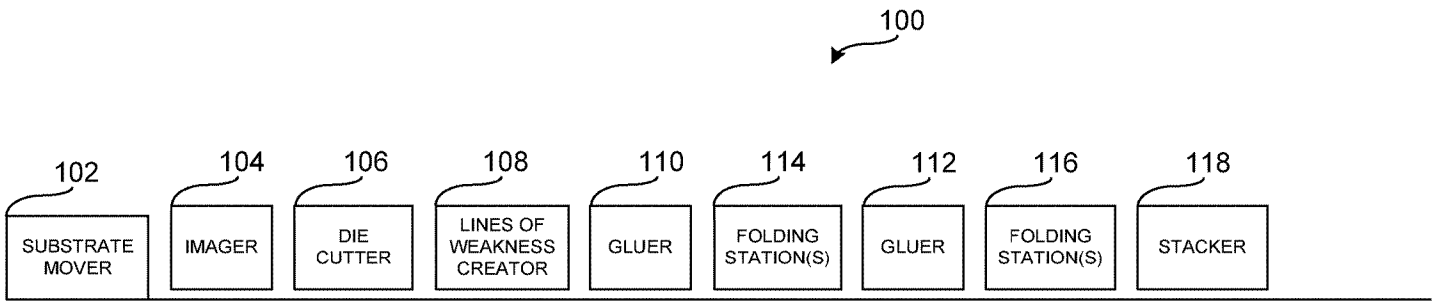
FIG. 1 depicts an example apparatus that can be used to produce the example gift card apparatus disclosed herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples. As used herein, the terms left and right are used for brevity and clarity and are no means limiting.

The examples disclosed herein relate to compact gift card assemblies including a gift card backer coupled to a container(s) and/or self-erecting gift box(s) via a line of weakness (e.g., a perforation). In some examples, the gift card assemblies are formed using a substrate that is cut, creased, perforated, scored, folded and/or glued. In some examples, the backer includes flaps and/or side panels that at least partially surround the broken down gift box (e.g., the non-erected gift box) to enable the gift card apparatus to be relatively flat and/or compact prior to, for example, a consumer purchase. Additionally or alternatively, in some examples, the backer is coupled to the broken down gift box using one or more glue dots to enable the gift card apparatus to be relatively flat and/or compact prior to, for example, a consumer purchase.

In some examples, prior to purchase, the gift card apparatus is folded relatively flat and hung from a hook with the gift card and the backer outwardly facing (e.g., facing an aisle, toward potential purchasers, etc.). Once the gift card is purchased, the purchaser may remove the gift card from the backer, separate the backer from the gift box and erect the gift box.

In some examples, the gift box is erected by pushing the sides of the gift box together and/or away from the bottom of the gift box, folding a front flap of the gift box toward the inside of the gift box and/or closing the lid. In some examples, to assist in erecting the gift box, the gift box and/or the backer may include instructions. The purchaser may position the gift card in the gift box and give the gift box including the gift card to a recipient. The erected gift box may be sized to enable the gift card to be positioned and/or presented in the gift box at an angle.

In some examples, the backer defines a window (e.g., a die cut window) to enable a barcode of the gift card coupled to the backer to be viewed and/or scanned through the window at, for example, the time of the purchase. In some examples, the backer and/or the gift box is imaged, glued (e.g., machine glued) and/or folded in-line to enable the self-erectable gift box to be positioned and/or hidden behind the backer and/or for the gift card apparatus to be relatively flat, compact, etc.

In some examples, the gift card apparatus is formed by printing and/or imaging a substrate and die cutting the printed substrate to form a blank having a cut(s), a crease(s), a perforation(s), a fold line(s), a cut/crease line(s) and, more generally, one or more lines of weakness. In some examples, the blank includes a backer card portion and a gift box portion. The backer may define a barcode cutout and a hanger cutout. The gift box may include a lid and a modified simplex tray defining a hanger cutout.

In some examples, to form the gift box, adhesive and/or glue may be applied to outer left and right side panels of the gift box and side glue areas of bellow corners of the gift box. Inner left and right side panels may be folded about respective fold lines and/or lines of weakness to couple the inner left side panel to the outer left side panel and the inner right side panel to the outer right side panel.

In some examples, to form a portion of the gift box, the bellow corners may be folded about corresponding fold lines and/or lines of weakness and the left and right side panels, which include the inner and outer side panels, may be folded about respective fold lines and/or lines of weakness to couple the side glue areas of the bellow corners to an outside front panel of the gift box and/or an outside back panel of the gift box. In some such examples, flanges coupled to the inside left and right side panels may be positioned adjacent a bottom panel of the gift box and may be used to secure and/or lock an inside front panel when the gift box is erected.

In some examples, to form a portion of the lid panel and/or cover, left and right lid side panels and the left and right lid flaps may be folded about respective fold lines and/or lines of weakness and left and right lid glue areas of the left and right lid side panels may be reverse folded about respective fold lines and/or lines of weakness. Adhesive and/or glue may be applied to the left and right lid glue areas and a front lid and/or lip panel may be folded about a fold line and/or line of weakness to couple the front lid panel to the left and right lid glue areas.

In some examples, the lid panel is folded about a fold line and/or line of weakness between the lid panel and the outside back panel. The outside front panel, the inside front panel, a flange coupled to the inside front panel, the front bellow corners and the backer may be folded about a fold line and/or line of weakness between the outside front panel and the bottom panel of the gift box. The inside front panel, the flange coupled to the inside front panel, and the backer may be reverse folded about a fold line and/or line of weakness between the outside front panel and the inside front panel.

In some examples, to couple the backer to the gift box and/or ready the gift card apparatus to be hung for retail sale and/or to have a gift card affixed thereto, an adhesive and/or glue (e.g., a glue dot, a fugitive glue) is applied to the backer and/or the gift box and the backer is folded about a fold line and/or line of weakness to couple the backer to the gift box and/or align the hanger cutouts of the backer and the gift box. Additionally or alternatively, in examples in which the backer includes left or right panels and/or flaps, to couple the backer to the gift box and/or ready the gift card apparatus to be hung for retail sale and/or to have a gift card affixed thereto, the backer is folded about a fold line and/or line of weakness to align the hanger cutouts of the backer and the gift box. An adhesive and/or glue is applied to the left panel or the right panel of the backer and the left and right panels of the backer are folded about respective fold lines and/or lines of weakness to at least partially surround the broken down gift box and couple the left and right panels of the backer together.

In some examples, to erect the gift box, the left and right panels of the backer are uncoupled and/or the backer is separated from the gift box along a fold line and/or line of weakness (e.g., a perforation). The lid panel, the left and right lid side panels and the front lid panel may be folded about the fold line between the lid panel and the outside back panel. The outside front panel, the inside front panel, and the flange coupled to the inside front panel may be folded about a fold line and/or line of weakness between the outside front panel and the bottom panel of the gift box. The left and right side panels may be folded about respective fold lines and the front and rear panels may be moved toward one another and the left and right side panels. The front inside panel may be folded about a fold line and/or line of weakness between the outside front panel and the inside front panel to enable the flange coupled to the inside front panel to engage the flanges of the left and right side panels to substantially prevent the inside front panel from reverse folding when the gift box is erected. The left and right lid panels and the front lid panel may be folded about respective fold lines and/or lines of weakness. The gift card may be removed from the backer, positioned within the gift box and the lid may be folded about a fold line and/or line of weakness such that the left and right lid side panels at least partially cover the outside left and right side panels and the front lid panel at least partially covers the outside front panel. In some examples, in the closed position, the lid panel and/or the bottom panel of the gift box are substantially parallel to one another. In some examples, in the closed position, the lid panel and/or the bottom panel of the gift box are substantially perpendicularly positioned relative to the front and back panels and the side panels. In some examples, in the closed position, the front panel is substantially parallel to the back panel. In some examples, in the closed position, the left side panel is substantially parallel to the right side panel. The term "substantially parallel" as used herein means within about 10 degrees of parallel and/or accounts for manufacturing tolerances. The term "substantially perpendicular" as used herein means within about 10 degrees of perpendicular and/or accounts for manufacturing tolerances.

FIG. 1 represents an example apparatus 100 that can be used to produce the example gift card apparatus disclosed herein. In some examples, the apparatus 100 may be an in-line process and includes a substrate mover 102, an imager 104, a die cutter 106, a lines of weakness creator 108, gluers 110, 112, folding stations 114, 116 and a stacker 118. While the stations and/or portions 102-118 of the apparatus 100 are depicted in a particular order, the stations and/or portions 102-118 may be differently arranged. While the apparatus 100 is depicted as having die cutter being separate from a lines of weakness creator, in other examples, the die cutter and the lines of weakness creator may be combined. While the apparatus 100 is depicted as having two gluers, in other examples, the apparatus 100 may have one gluer or three or more gluers. While the apparatus 100 is depicted as having two folding stations, in other examples, the apparatus 100 may have one folding stations or three or more folding stations. While the apparatus 100 is depicted as having a gluer being separate from a folding station, in other examples, the gluer(s) and the folding station(s) may be combined.

In operation, in some examples, the substrate mover 102 may feed one or more pieces of substrate and/or a web of substrate into the apparatus 100. In some examples, the imager 104 images a first and/or a second side of the substrate. The images may include brand-related images and/or text, instructional images and/or text, etc. The die cuter 106 may die cut the substrate to form a blank and a waste matrix and the lines of weakness creator 108 may form one or more lines of weakness on the first and/or second sides of the blank using a die(s), a cutting tool(s), a scoring tool(s), a slotting tool(s), etc. The gluers 110, 112 may apply glue to one or more portions of the blank and the folding stations 114, 116 may fold the blank along one or more lines of weakness to form the gift card apparatus. The stacker 118 may stack gift card apparatus for packaging, etc. In some examples, the apparatus 100 includes a station (e.g., between the folding station 116 and the stacker 118) to couple a gift card to a backer of the gift card apparatus. In other examples, the gift card may be attached at a later point in time.

Figure 2:
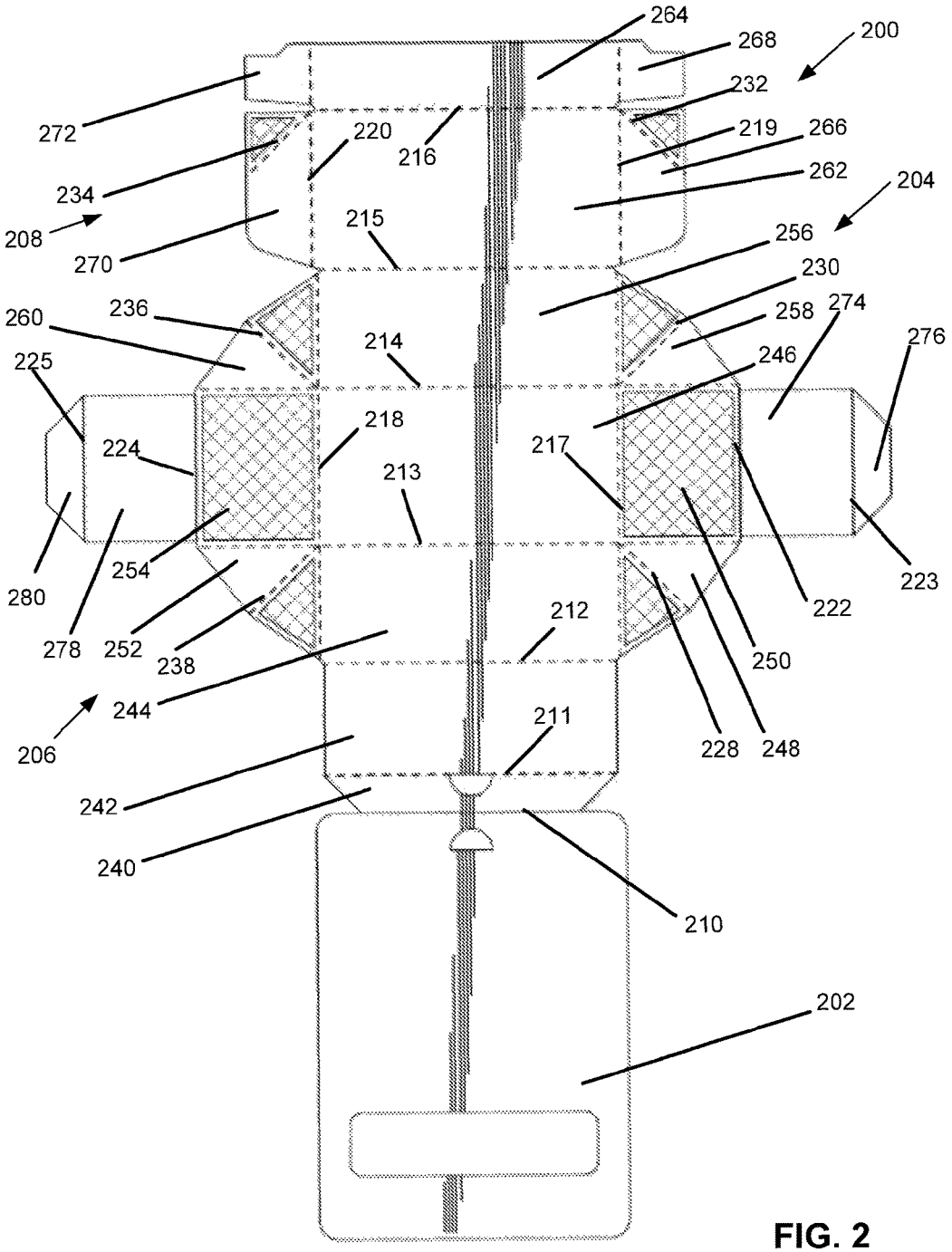
FIGS. 2-16 depict the fabrication of an example gift card apparatus in accordance with the teachings of this disclosure.
Figure 3:
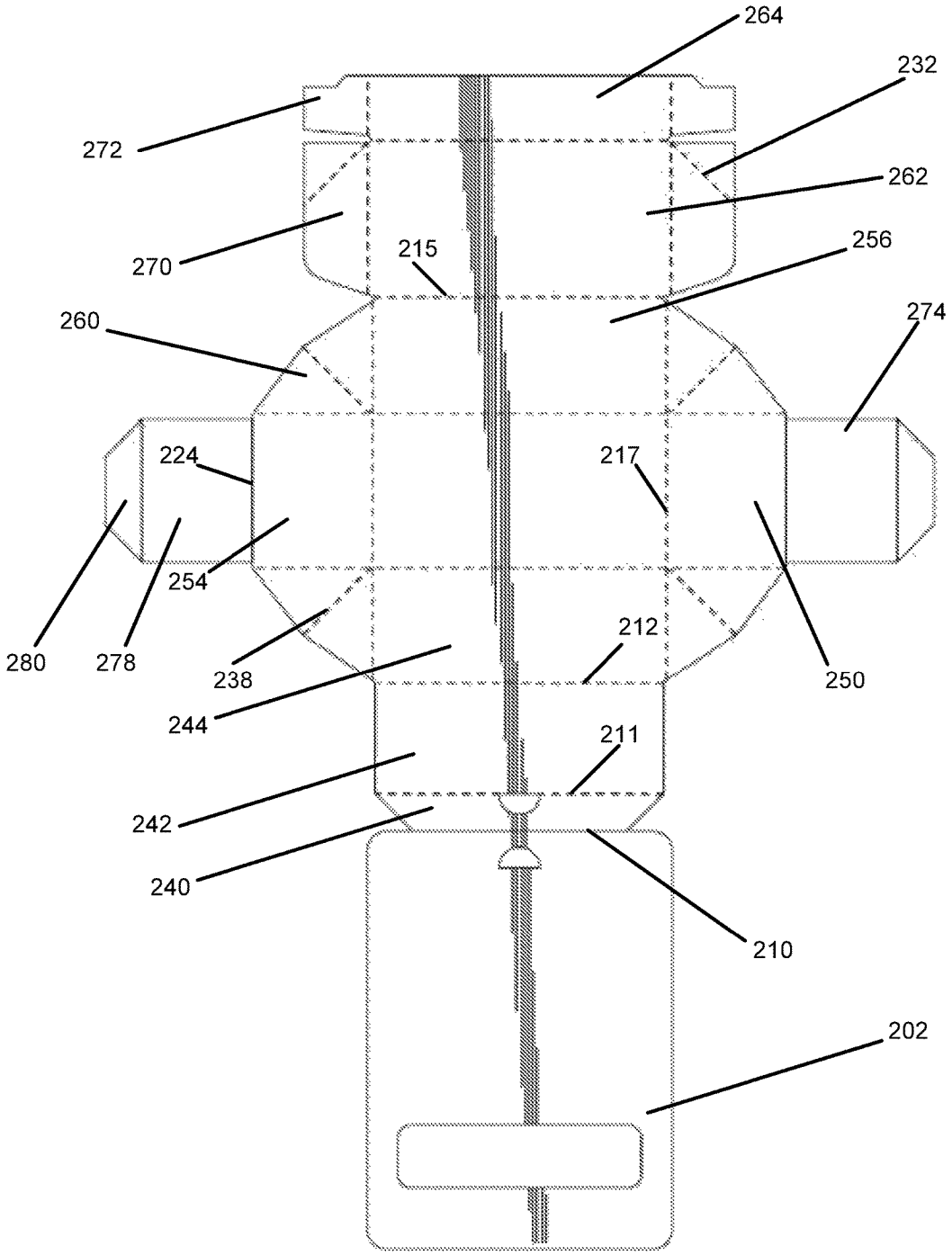

FIGS. 2 and 3 depict an example blank gift card apparatus 200 in accordance with the teaching of this disclosure. In the illustrated example, the blank 200 includes a backer card portion 202 and a gift box portion 204 including a modified simplex tray 206 and a lid 208. In some examples, the blank 200 includes first through seventh lines of weakness 210-216, which are substantially parallel to one another. In some examples, the blank 200 includes eighth through fifteenth lines of weakness 217-225, which are substantially parallel to one another. In some examples, the blank 200 includes sixteenth through twenty first lines of weakness 228-238 that are at about a forty five degree angle relative to the first through seventh lines of weakness 210-216. In some examples, the sixteenth through twenty first lines of weakness 228-238 are cut/creases.

In some examples, the first line of weakness 210 is a perforation that couples the backer 202 and a flange 240 having edges at about a forty five degree angle relative to the first line of weakness 210. In some examples, the second line of weakness 211 is a score and/or fold line that couples the flange 240 and a front inside panel 242. In some examples, the third line of weakness 212 is a score and/or fold line that couples the front inside panel 242 and an outside front panel 244. In some examples, the fourth line of weakness 213 is a score and/or fold line that couples the outside front panel 244 and a bottom panel 246. In some examples, the fourth line of weakness 213 couples a first bellow corner 248 and an outer right side panel 250 and a second bellow corner 252 and an outside left panel 254. In some examples, the fifth line of weakness 214 is a score and/or fold line that couples the bottom panel 246 and an outside back panel 256. In some examples, the fifth line of weakness 214 couples the outer right side panel 250 and a third bellow corner 258 and the outside left panel 254 and a fourth bellow corner 260. In some examples, the sixth line of weakness 215 is a score and/or fold line that couples the outside back panel 256 with a lid panel 262. In some examples, the seventh line of weakness 216 is a score and/or fold line that couples the lid panel 262 and a front lip and/or lid panel 264.

In some examples, the eighth line of weakness 217 is a fold line and/or score that couples the first bellow corner 248 and the outside front panel 244, the outer right side panel 250 and the bottom panel 246 and the third bellow corner 258 and the outside back panel 256. In some examples, the ninth line of weakness 218 is a fold line and/or score that couples the second bellow corner 252 and the outside front panel 244, the outside left panel 254 and the bottom panel 246 and the fourth bellow corner 260 and the outside back panel 256. In some examples, the tenth line of weakness 219 is a fold line and/or score that couples a right lid panel 266 and the lid panel 262 and a right lid flap 268 and the front lid panel 264. In some examples, the eleventh line of weakness 220 is a fold line and/or score that couples a left lid panel 270 and the lid panel 262 and a left lid flap 272 and the front lid panel 264. In some examples, the twelfth lines of weakness 222 is a fold line and/or score that couples the outer right side panel 250 and an inner right side panel 274. In some examples, the thirteenth line of weakness 223 is a cut/crease that couples the inner right side panel 274 and a flange 276 having edges at about a forty five degree angle relative to the line of weakness 223. In some examples, the fourteenth line of weakness 224 is a score and/or a line of weakness that couples the outside left panel 254 and an inside left panel 278. In some examples, the fifteenth line of weakness 225 is a cut/crease that couples the inside left panel 278 and a flange 280 having edges at about a forty five degree angle relative to the line of weakness 225.

FIGS. 4-16 depict the process of forming a gift card apparatus from the blank 200 after imaging and/or forming the lines of weakness 210-238. In some examples, the blank 200 has first and second opposing surfaces 400, 401. In some examples, the blank 200 includes the backer 202 and the gift box 204. The backer 202 may define a barcode cutout 402 and a hanger cutout 404. The gift box 204 may include the lid 208 and the modified simplex tray 206 defining a hanger cutout 406.

Figure 4:
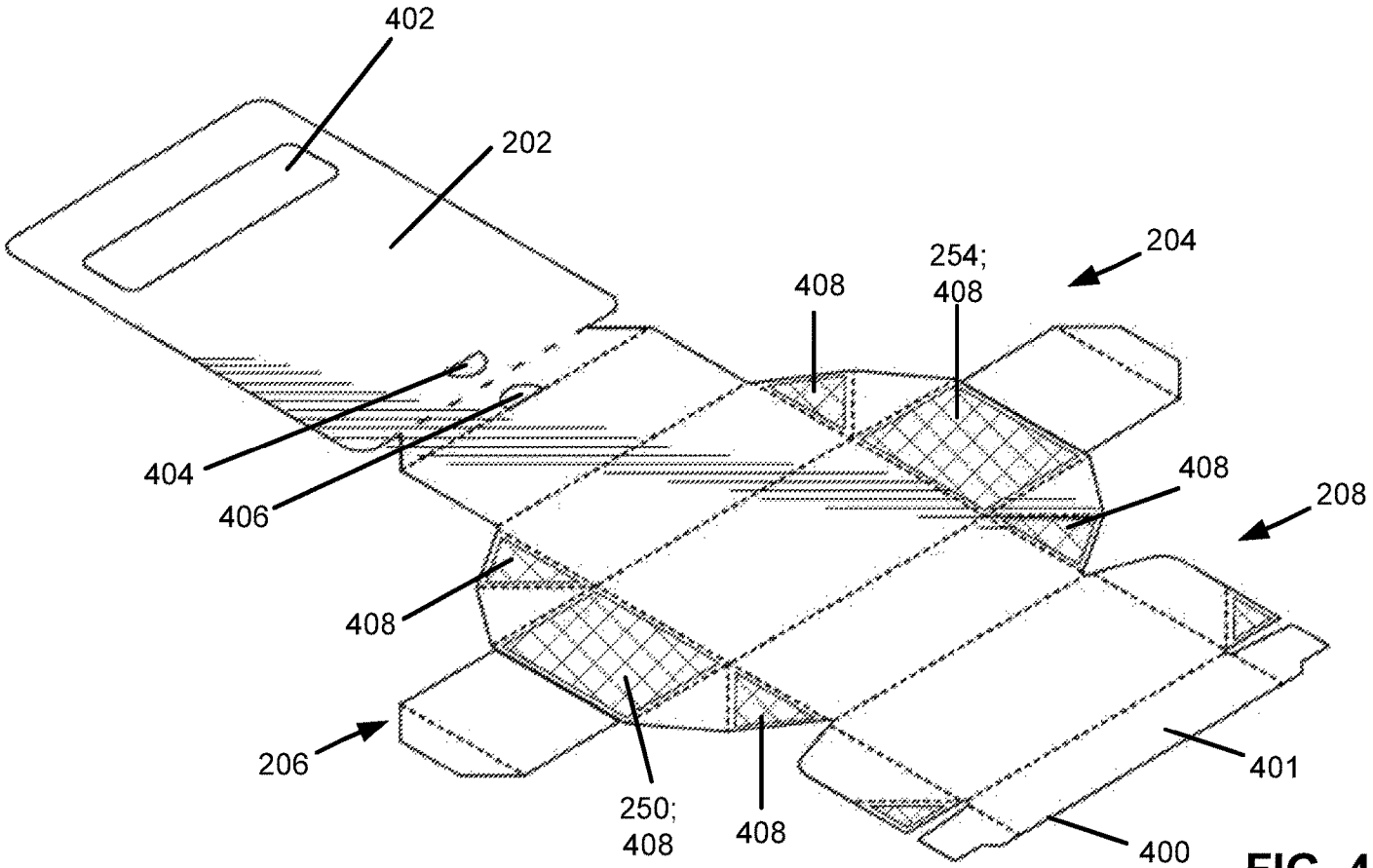
Figure 5:
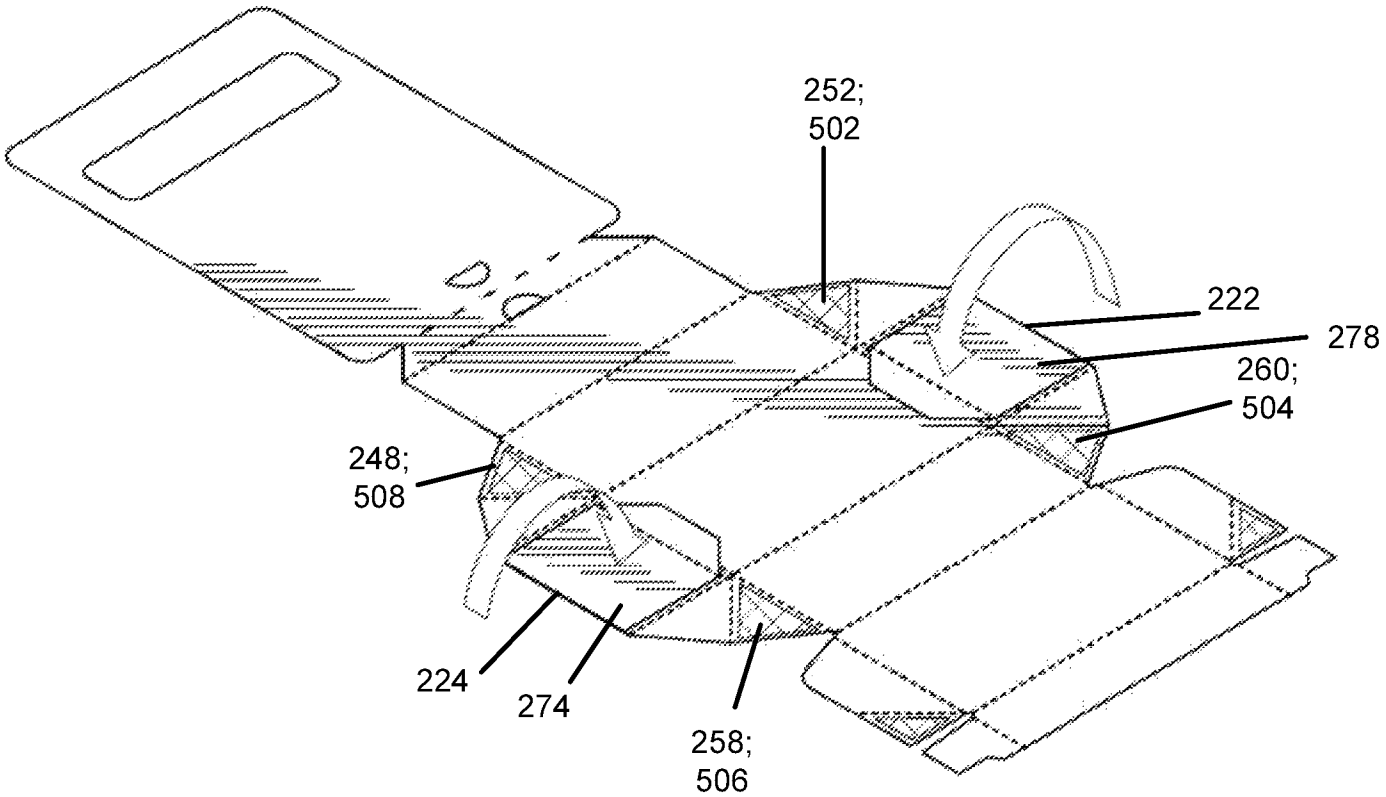

As shown in FIGS. 4 and 5, in some examples, to form the gift box 204, adhesive and/or glue 408 may be applied to the second surface 401 at the outer left and right side panels 250, 254 and side glue areas 502-508 of the bellow corners 248, 252, 258 and 260. The inner left and right side panels 274, 278 may be folded about the lines of weakness 222, 224 to couple the inner left side panel 278 to the outer left side panel 254 and the inner right side panel 274 to the outer right side panel 250.

Figure 6:
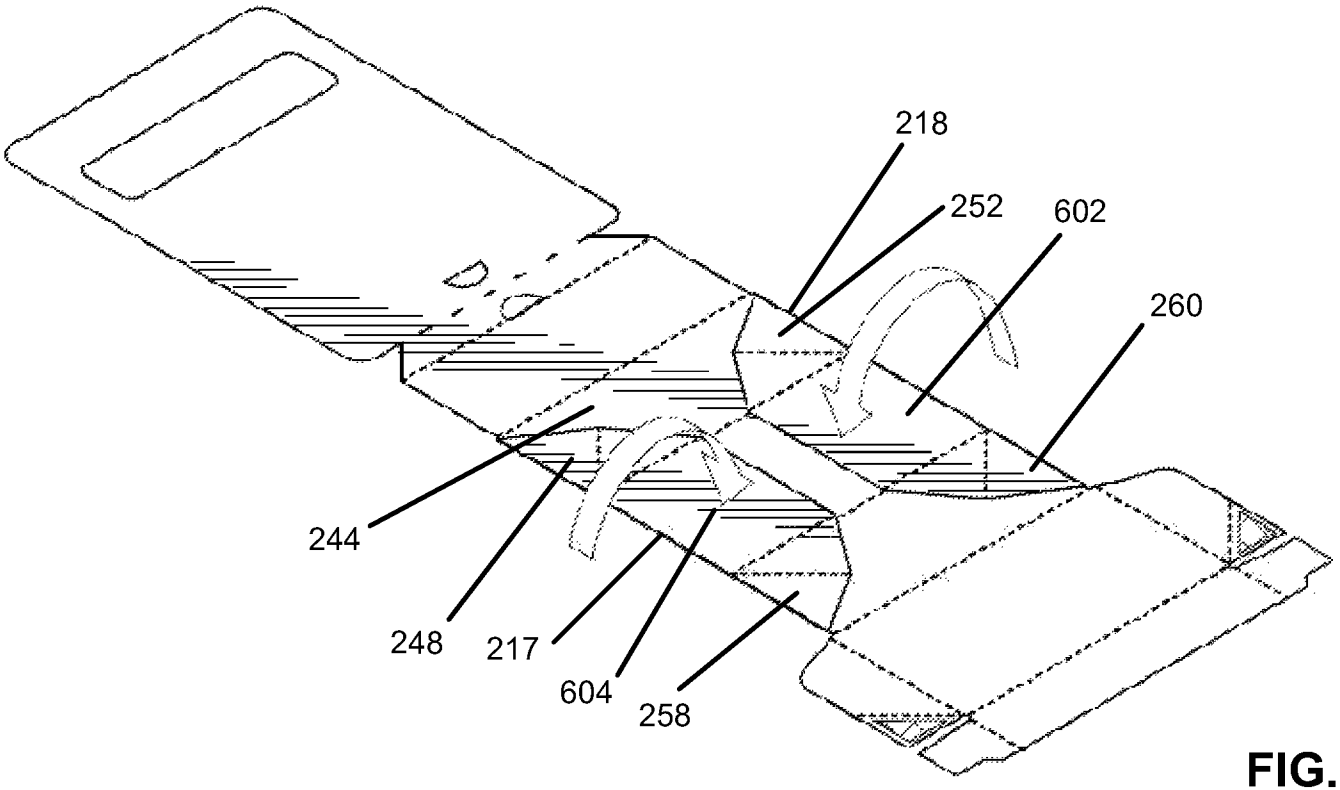

As shown in FIG. 6, to form a portion of the gift box 204, the bellow corners 248, 252, 258 and 260, a left panel 602 and a right panel 604 may be inwardly folded about the lines of weakness 217, 218 to couple the side glue areas 502-508 of the bellow corners 248, 252, 258 and 260 to the outside front panel 244 and/or the outside back panel 256. In some such examples, the flanges 276, 280 may be positioned adjacent the bottom panel 246 and may be used to secure and/or lock the inside front panel 242 when the gift box 204 is erected.

Figure 7:
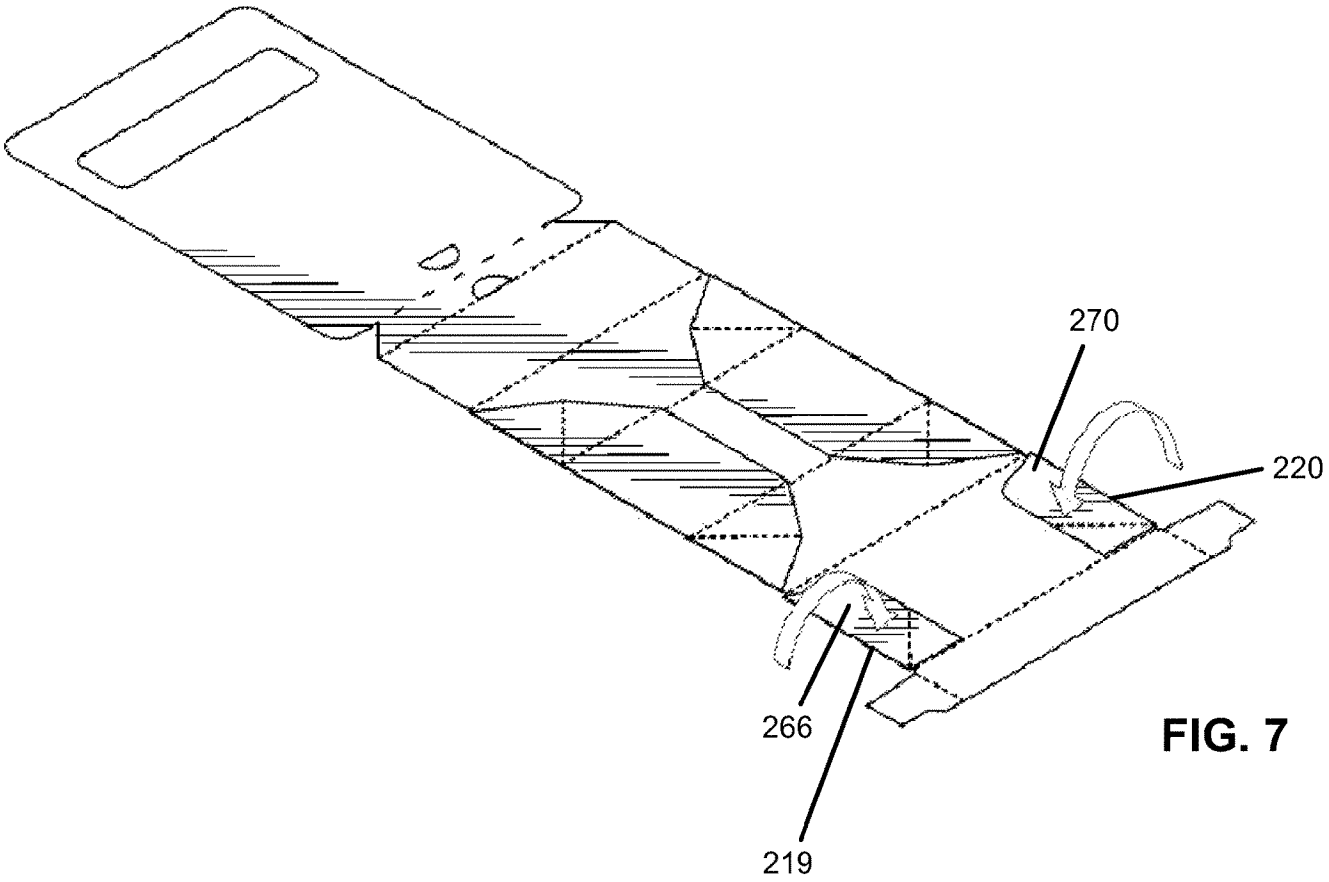
Figure 8:
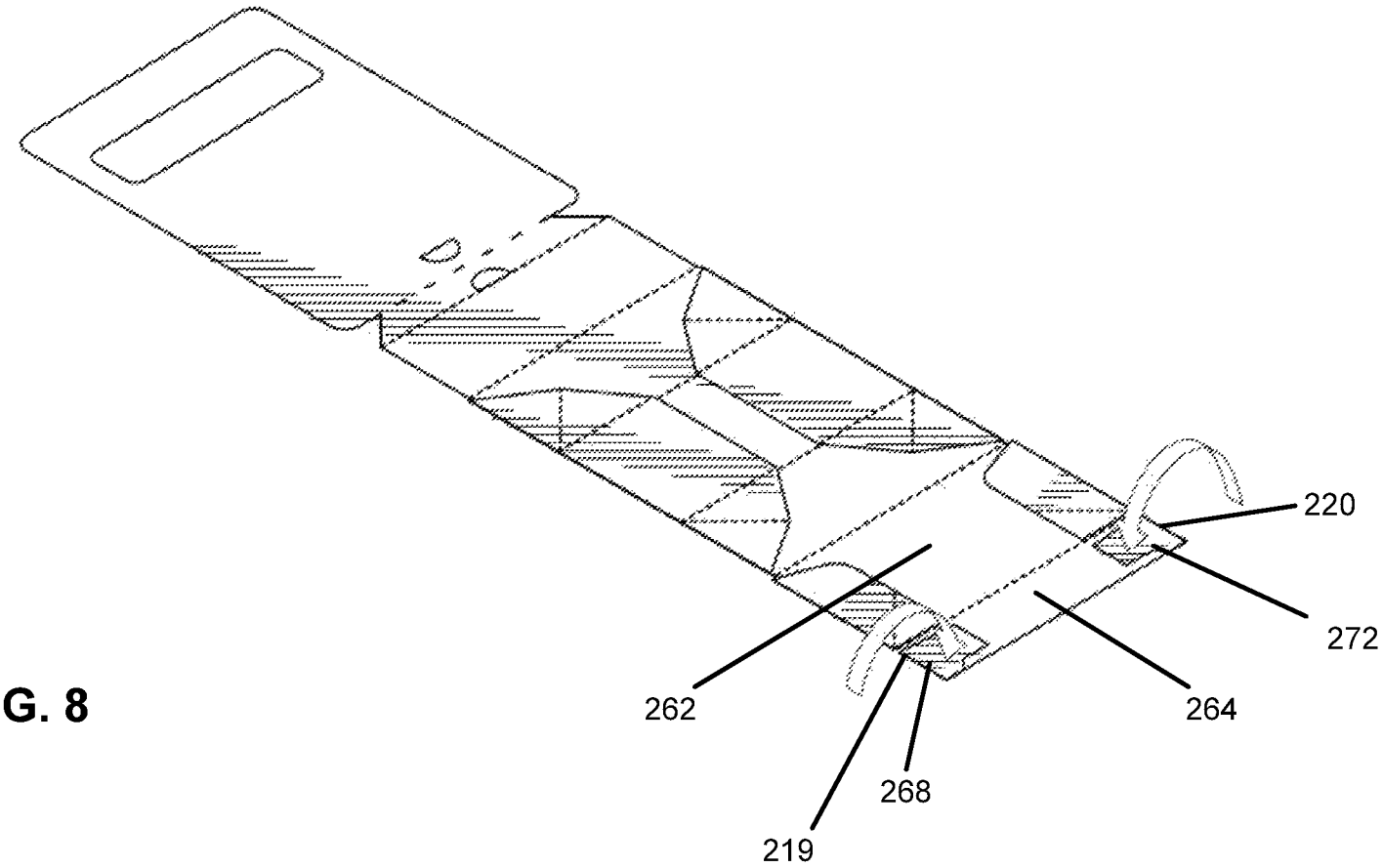
Figure 9:
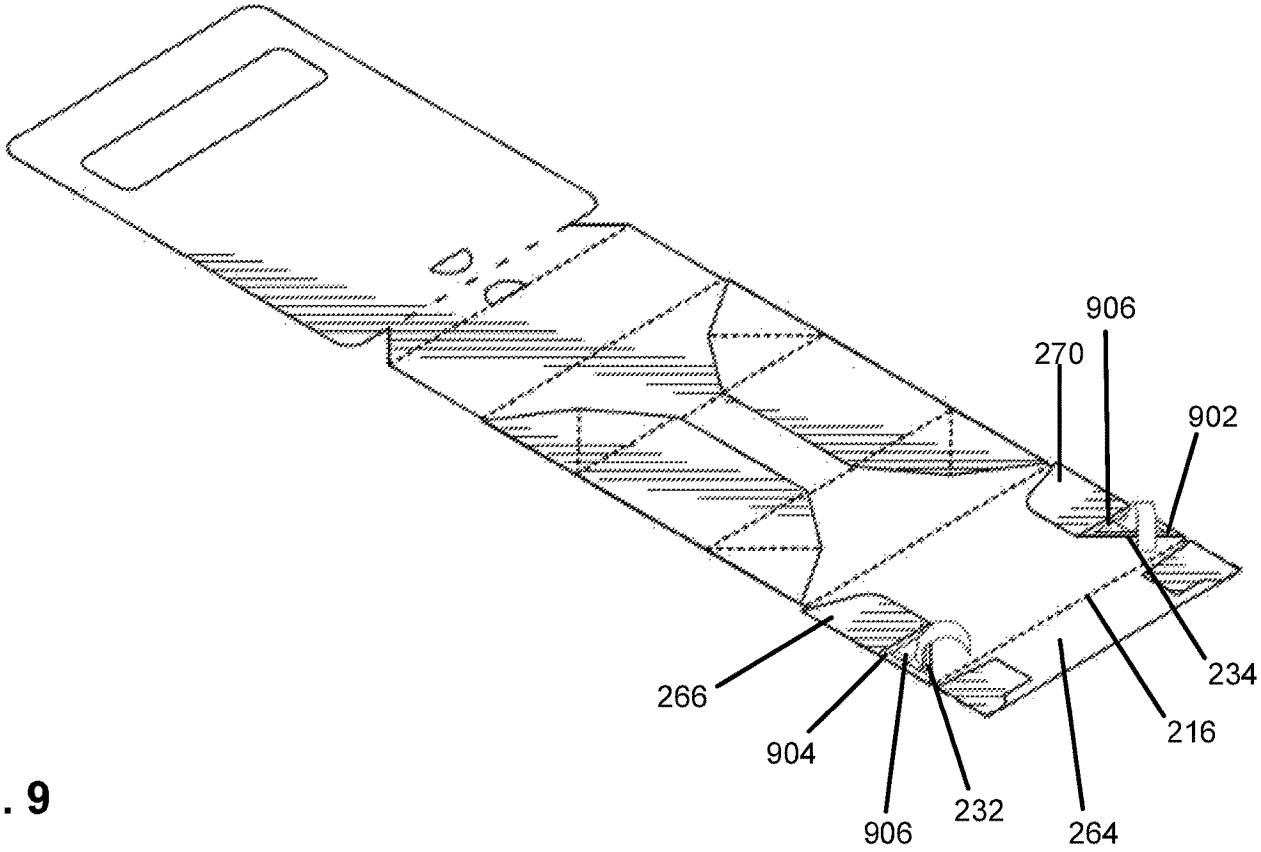
Figure 10:
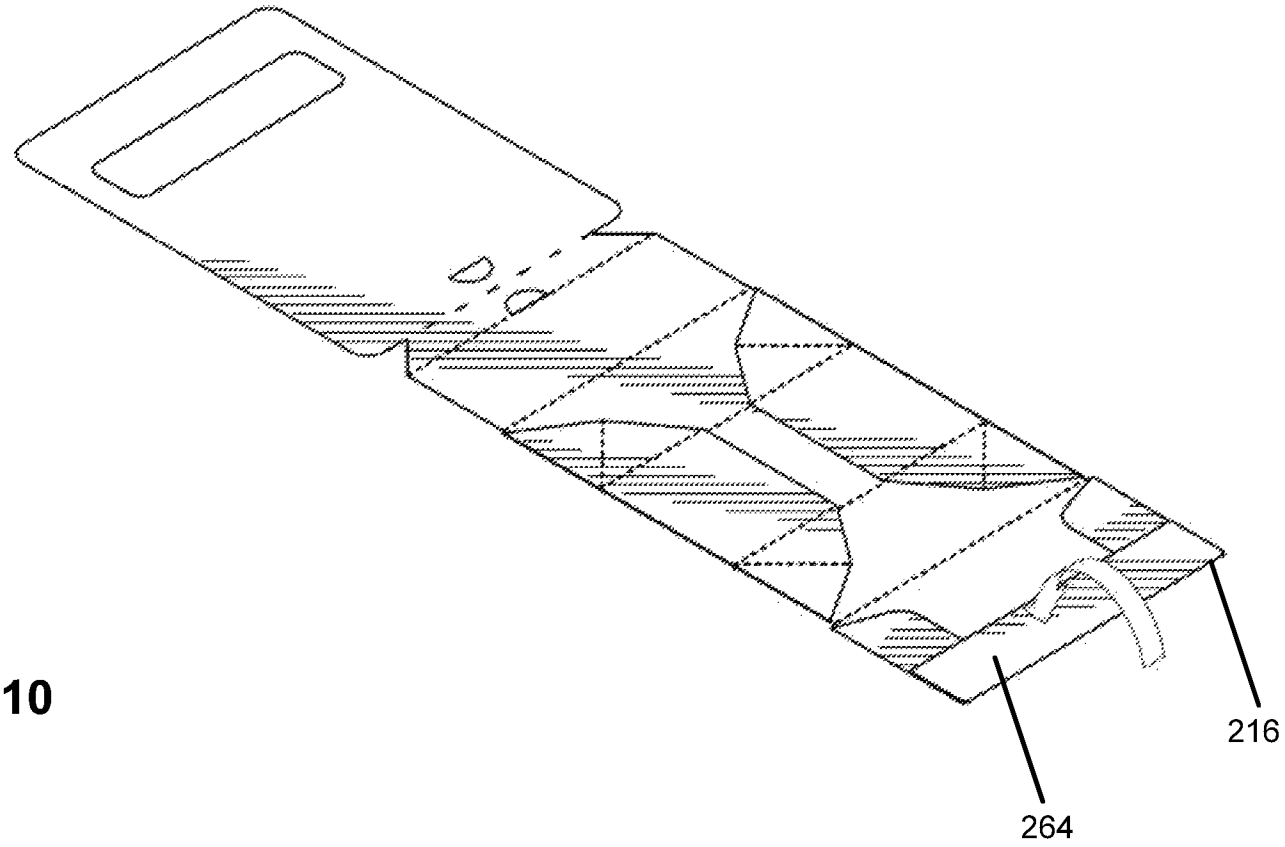

As shown in FIGS. 7 and 8, in some examples, to form a portion of the lid, the left and right lid side panels 266, 270 and the left and right lid flaps 268, 272 may be folded about the lines of weakness 219, 220. As shown in FIGS. 9 and 10, in some examples, left and right lid glue areas 902, 904 of the left and right lid side panels 266, 270 may be reverse folded about the lines of weakness 232, 234. Adhesive and/or glue 906 may be applied to the left and right lid glue areas 902, 904 and the front lid panel 264 may be folded about the line of weakness 216 to couple the front lid panel 264 to the left and right lid glue areas 902, 904.

Figure 11:
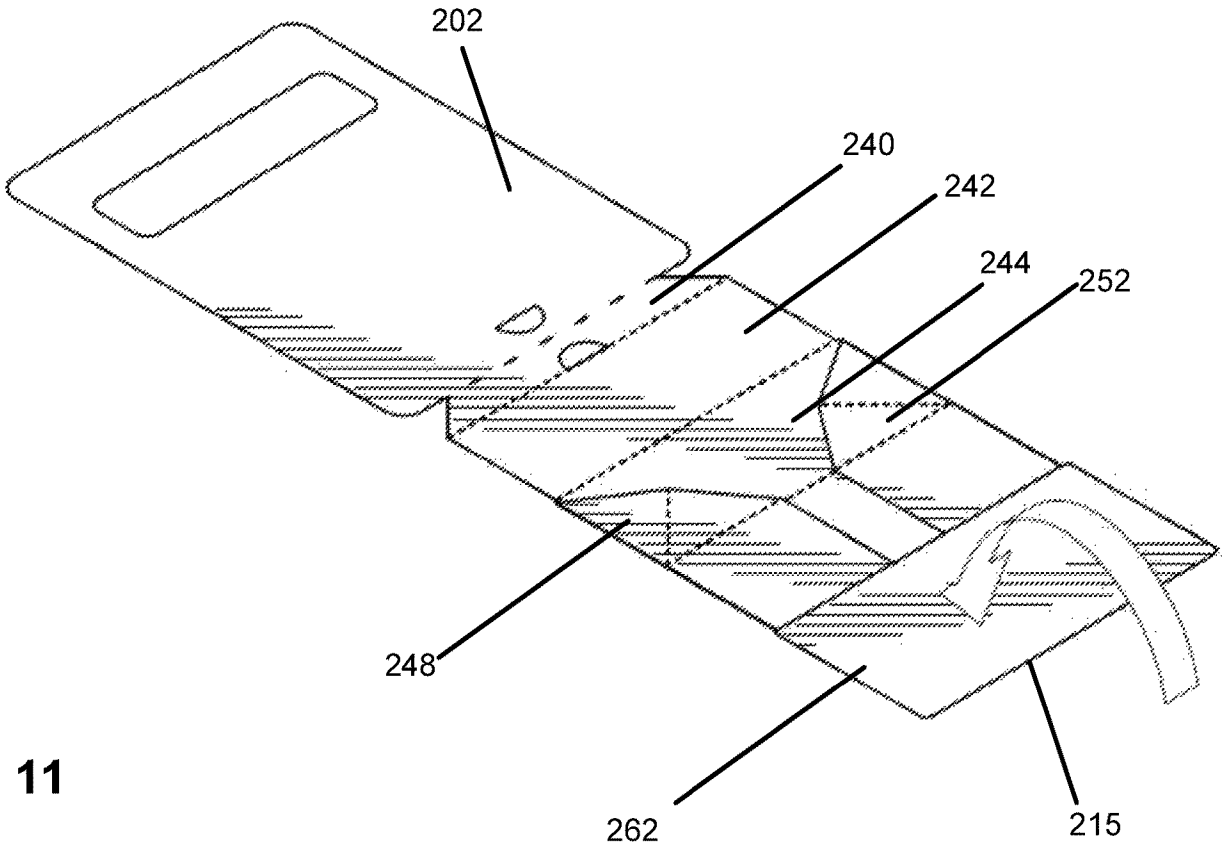
Figure 12:
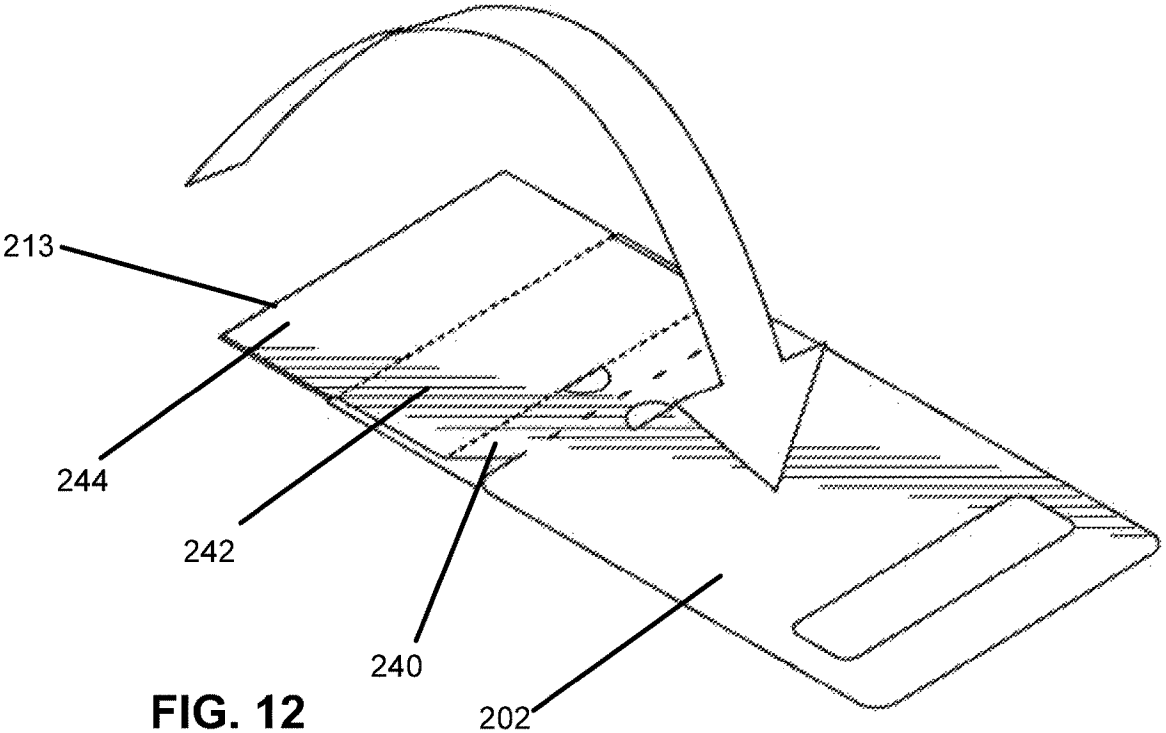
Figure 13:
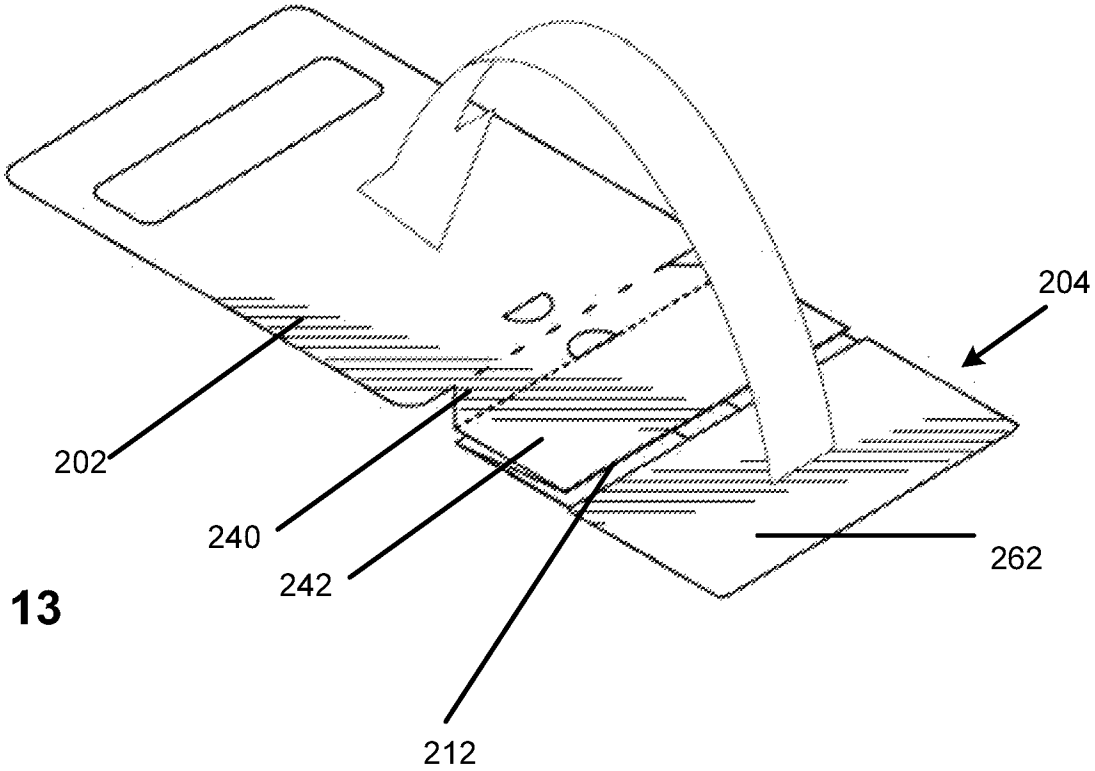

As shown in FIGS. 10 and 11, in some examples, the front lid panel 264 may be folded about the line of weakness 216 and the lid panel 262, the front lid panel 264, the left and right lid panels 266, 270 and the lid flaps 268 and 272 may be folded the line of weakness 215. In some examples, as shown in FIG. 12, the outside front panel 244, the inside front panel 242, the flange 240, the first and second bellow corners 248, 252 and the backer 202 may be folded about the line of weakness 213 between the outside front panel 244 and the bottom panel 246. As shown in FIG. 13, the inside front panel 242, the flange 240 and the backer 202 may be reverse folded about the line of weakness 212 between the outside front panel 244 and the inside front panel 242.

Figure 14:
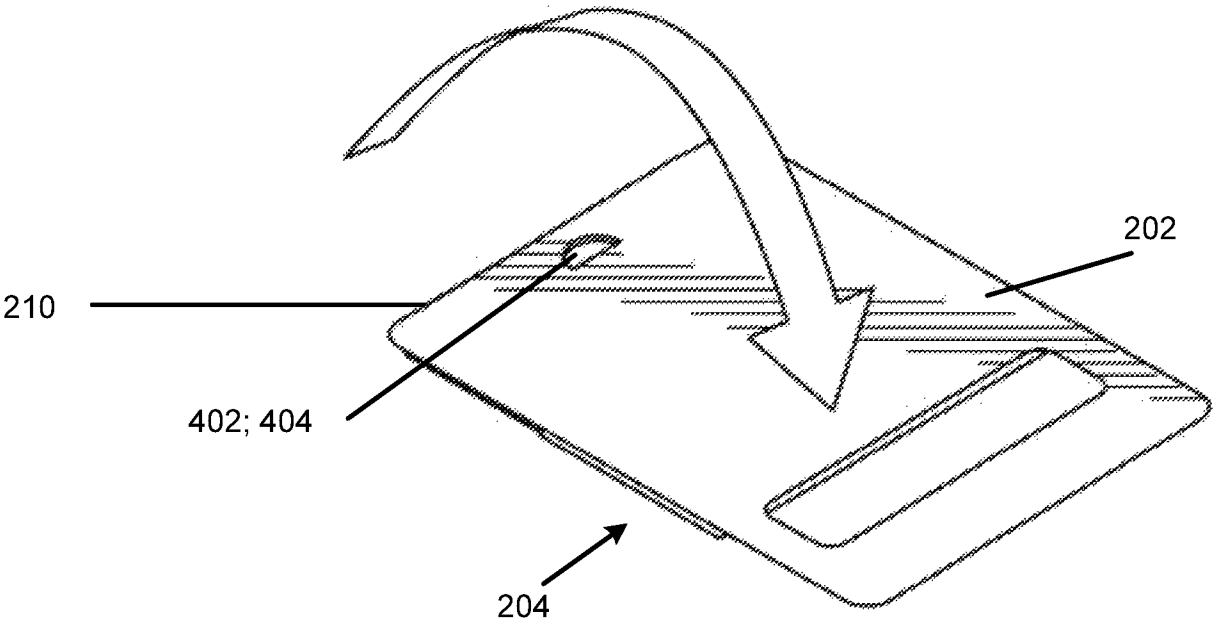

As shown in FIGS. 13 and 14, in some examples, to couple the backer 202 to the gift box 204 and/or ready the gift card apparatus to be hung for retail sale and/or to have a gift card affixed thereto, an adhesive and/or glue (e.g., a glue dot, a fugitive glue) is applied to the backer 202 and/or the gift box 204 and, as shown in FIG. 14, the backer 202 is folded about the line of weakness 210 to couple the backer 202 to the gift box 204 and/or align the hanger cutouts 402, 404 of the backer 202 and the gift box 204.

Figure 15:
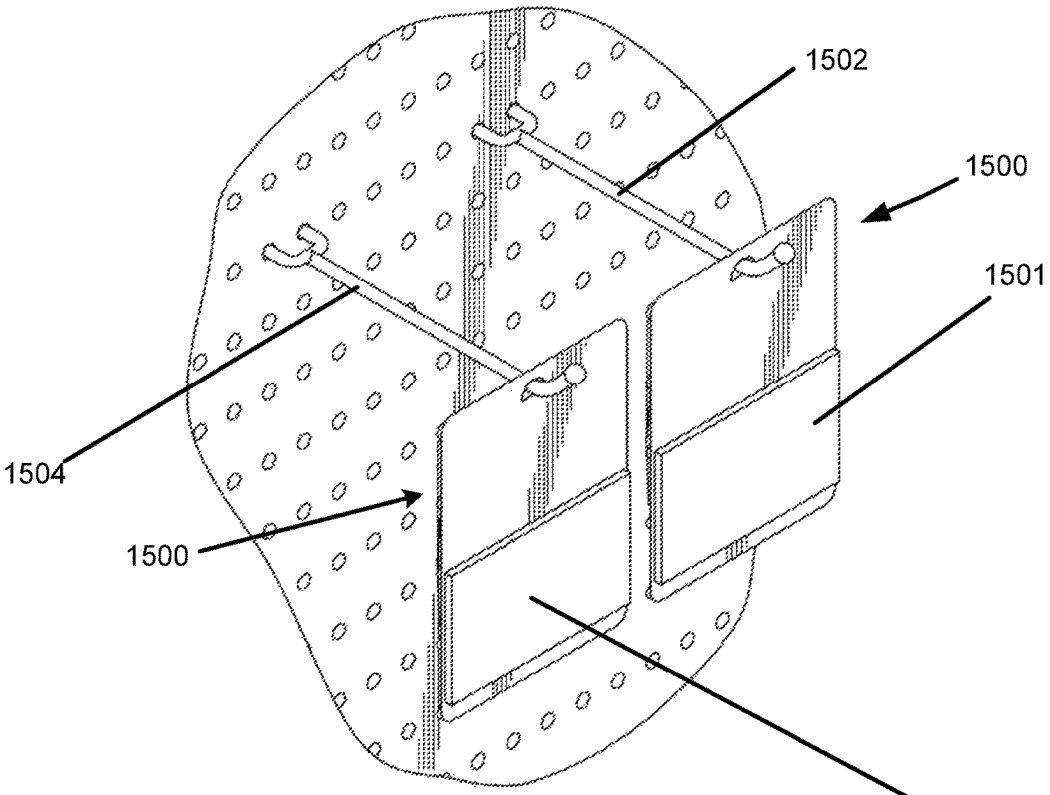
Figure 16:
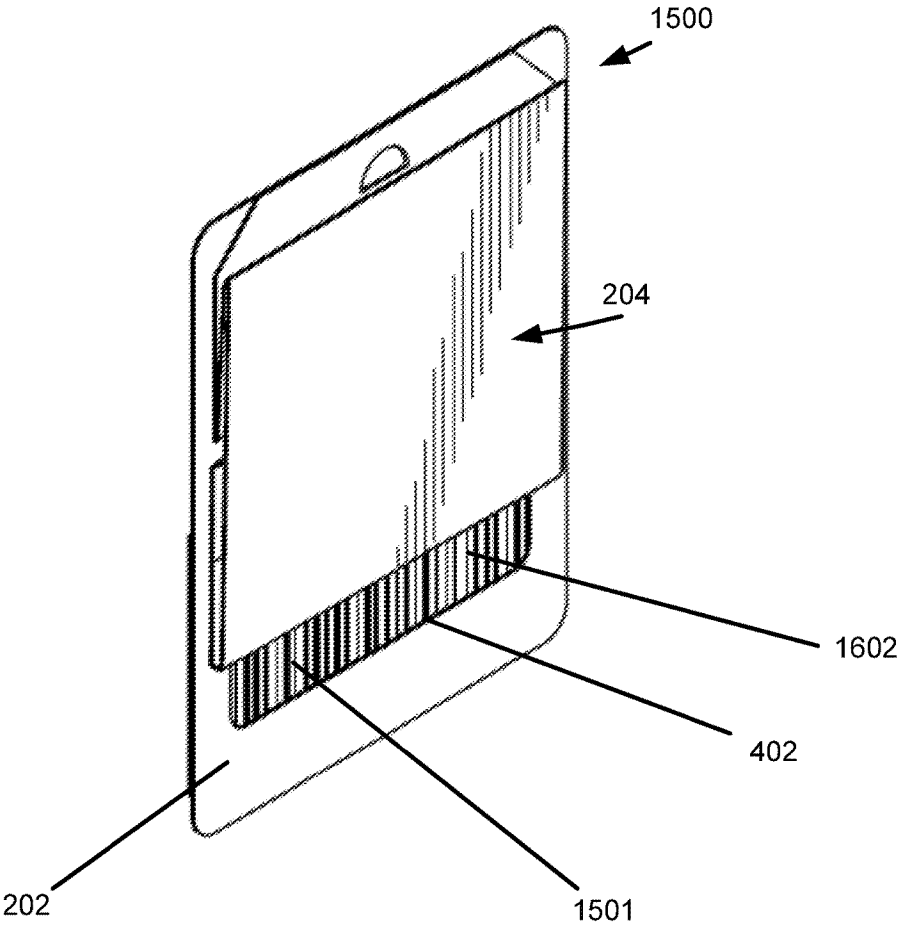

FIG. 15 illustrates example gift card assemblies 1500 having gift cards 1501 coupled thereto being hung on respective hooks 1502, 1504. FIG. 16 illustrates a barcode 1602 of the gift card 1501 being visible through the barcode cutout 402 and the gift box 204 being positioned behind and/or partially hidden by the backer 202.

Figure 17:
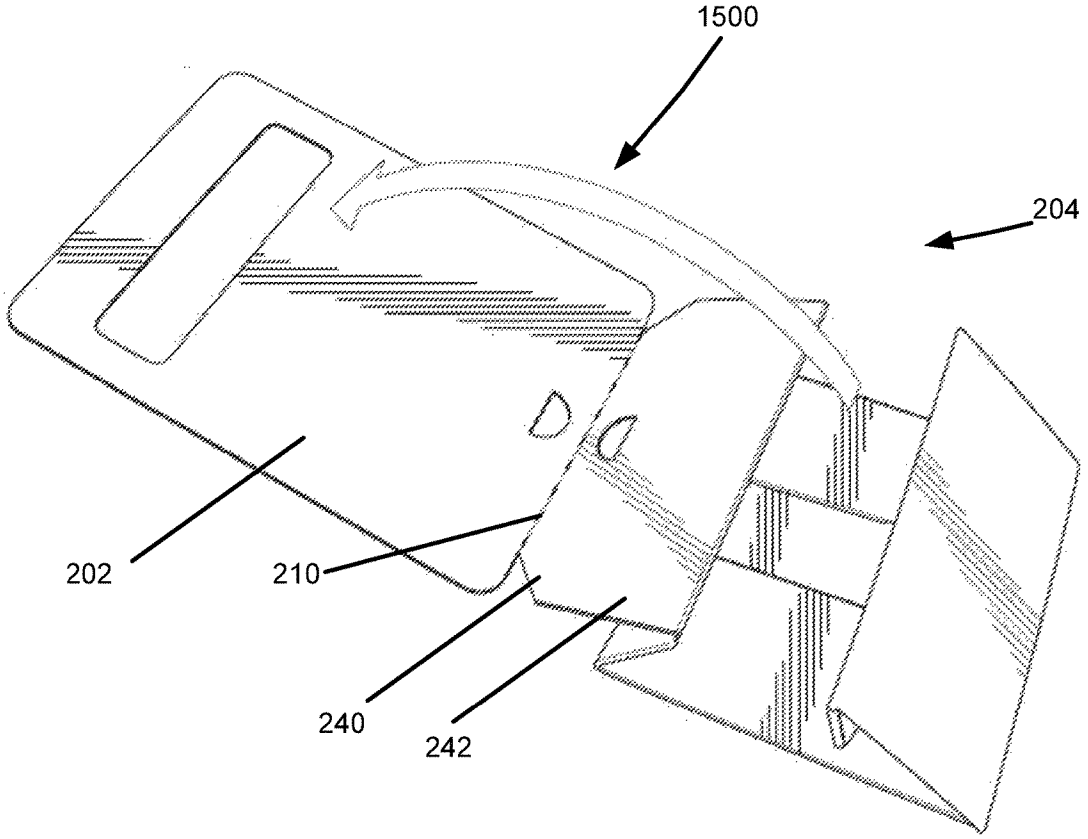
FIGS. 17-23 depict the assembly of an example gift card apparatus by a consumer in accordance with the teachings of this disclosure.
Figure 18:
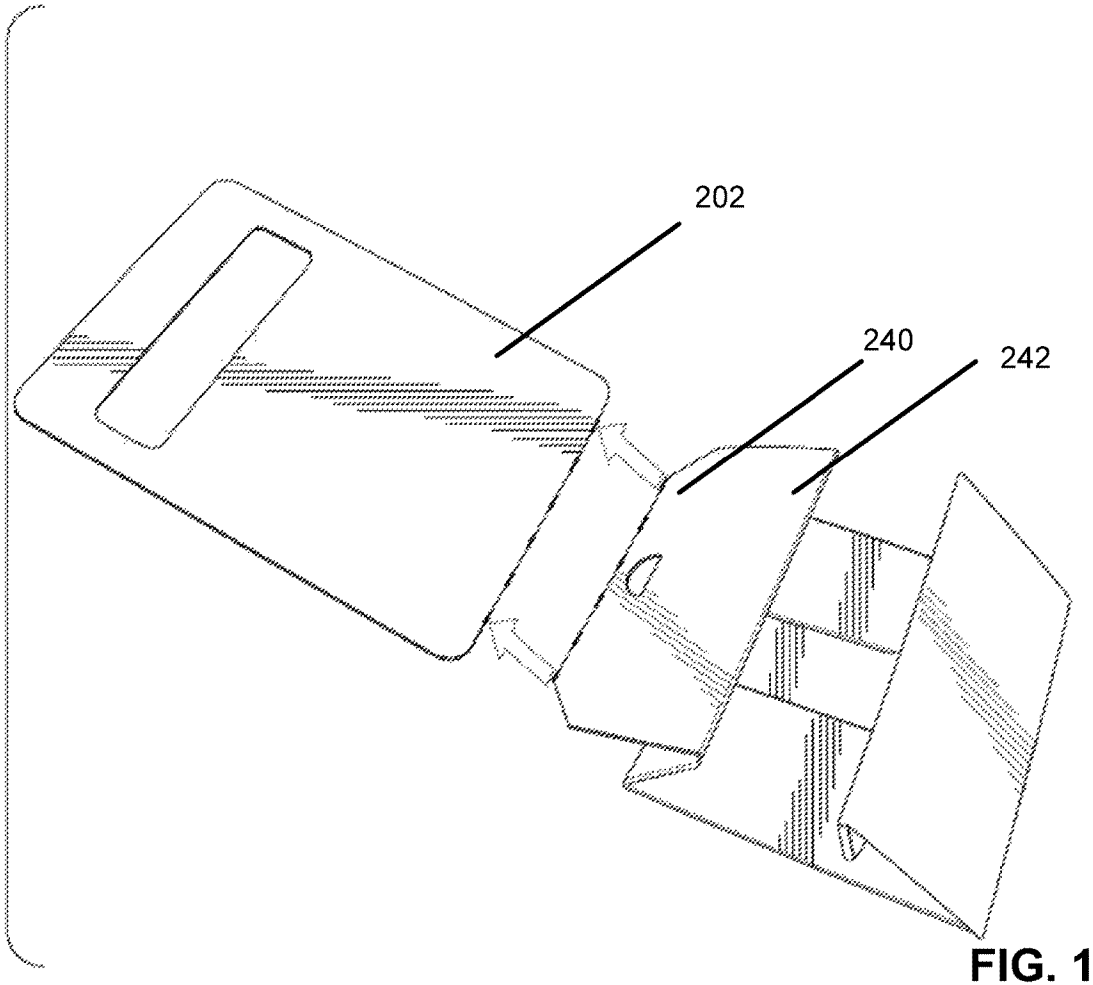
Figure 19:
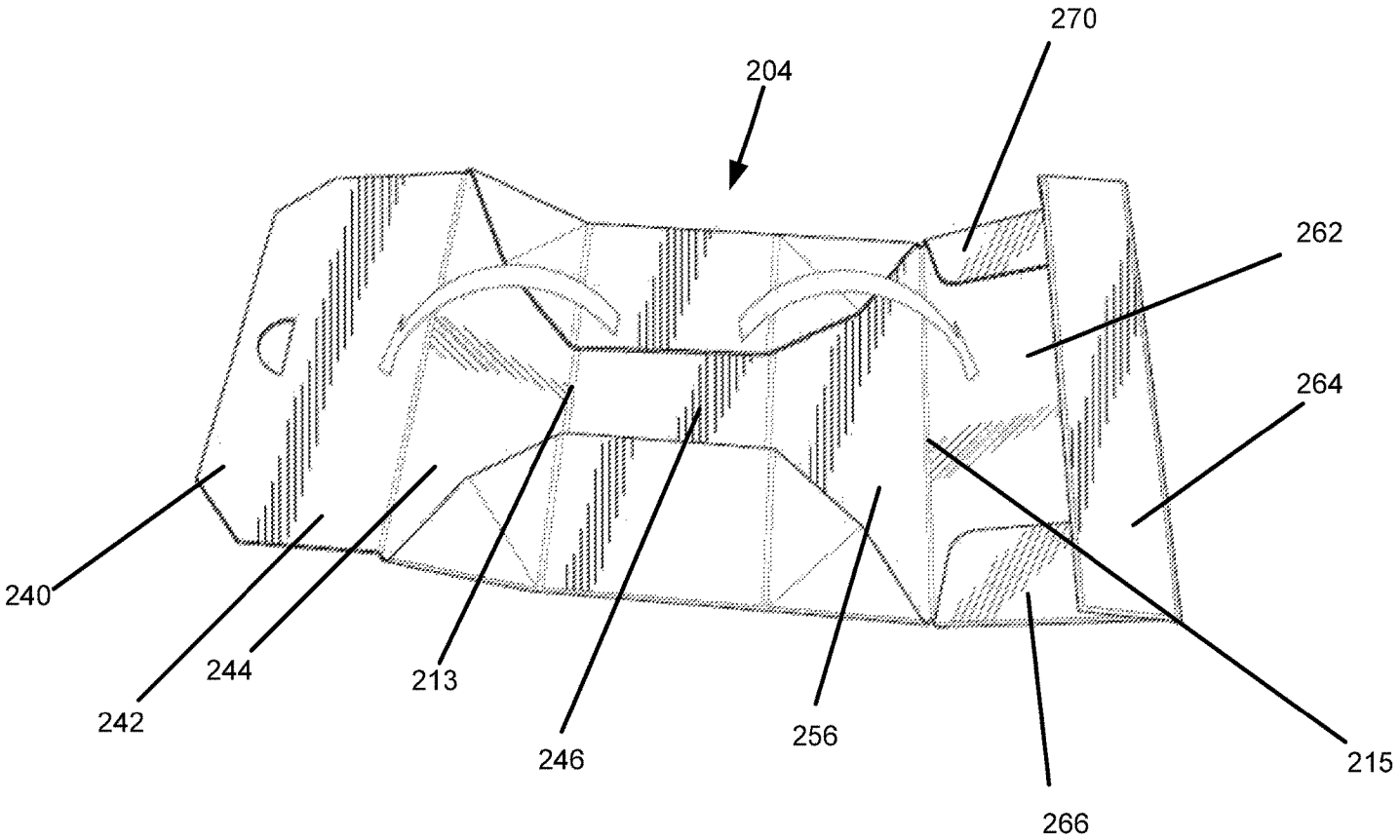
Figure 20:
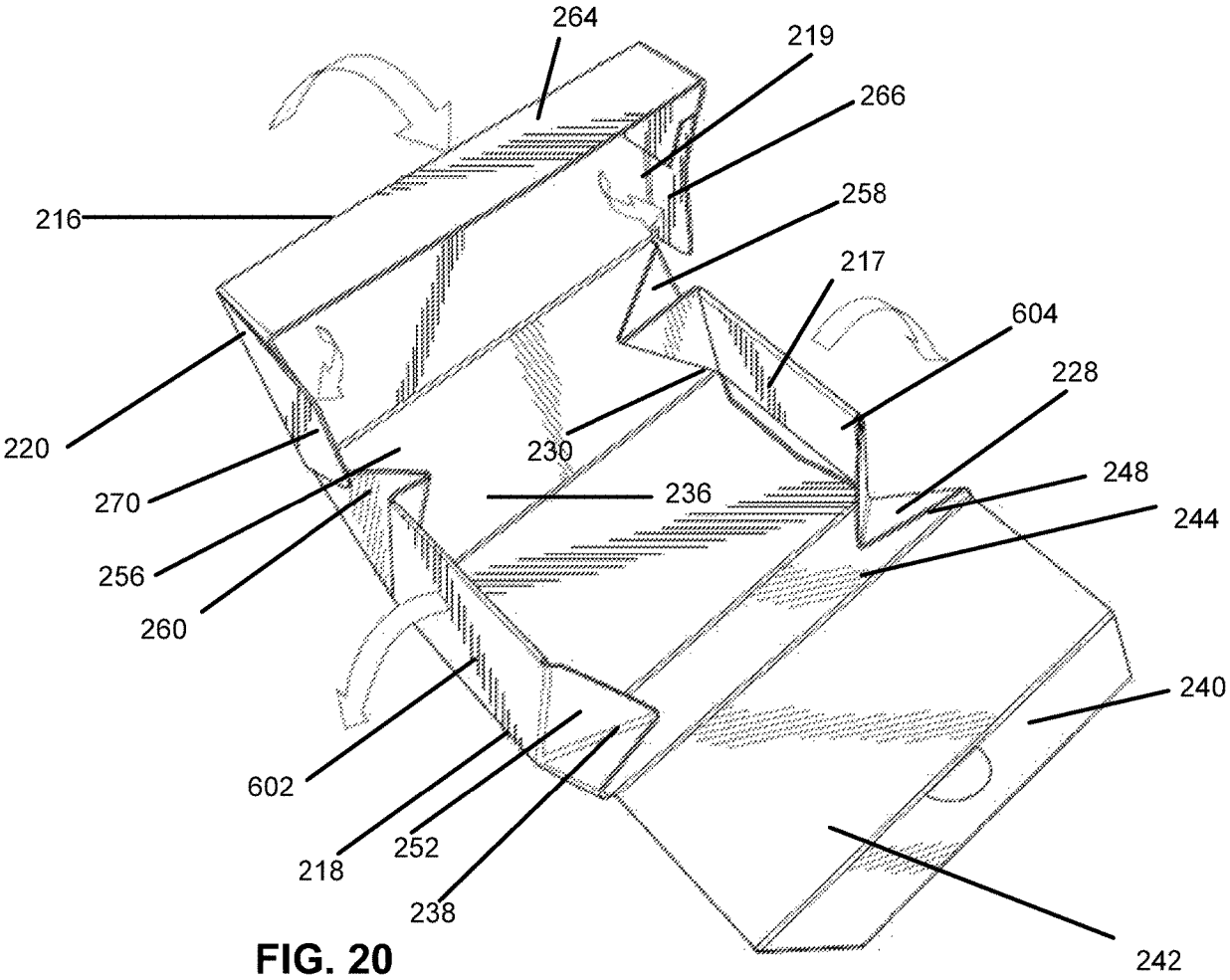

FIGS. 17-23 depict the process of erecting the gift box 204 from the gift card apparatus 1500. As shown in FIGS. 17 and 18, to erect the gift box 204, the backer 202 is separated from the gift box 204 along the line of weakness (e.g., a perforation) 210. As shown in FIG. 19, in some examples, the lid panel 262, the left and right lid side panels 266, 270 and the front lid panel 264 may be folded about the fold line 215 between the lid panel 262 and the outside back panel 256. Also, as shown in FIG. 19, the outside front panel 244, the inside front panel 242, and the flange 240 may be folded about the line of weakness 213 between the outside front panel 244 and the bottom panel 246 of the gift box 204. As shown in FIG. 20, the left and right side panels 602, 604 and the bellow corners 248, 252, 258 and 260 may be folded about the lines of weakness 217, 218, 228, 230, 236, 238 and the front and rear panels 242, 244, 256 may be moved toward one another and the left and right side panels 602, 604. The left and right lid panels 266 and 270 and the front lid panel 264 may be folded about the lines of weakness 216, 219 and 220.

Figure 21:
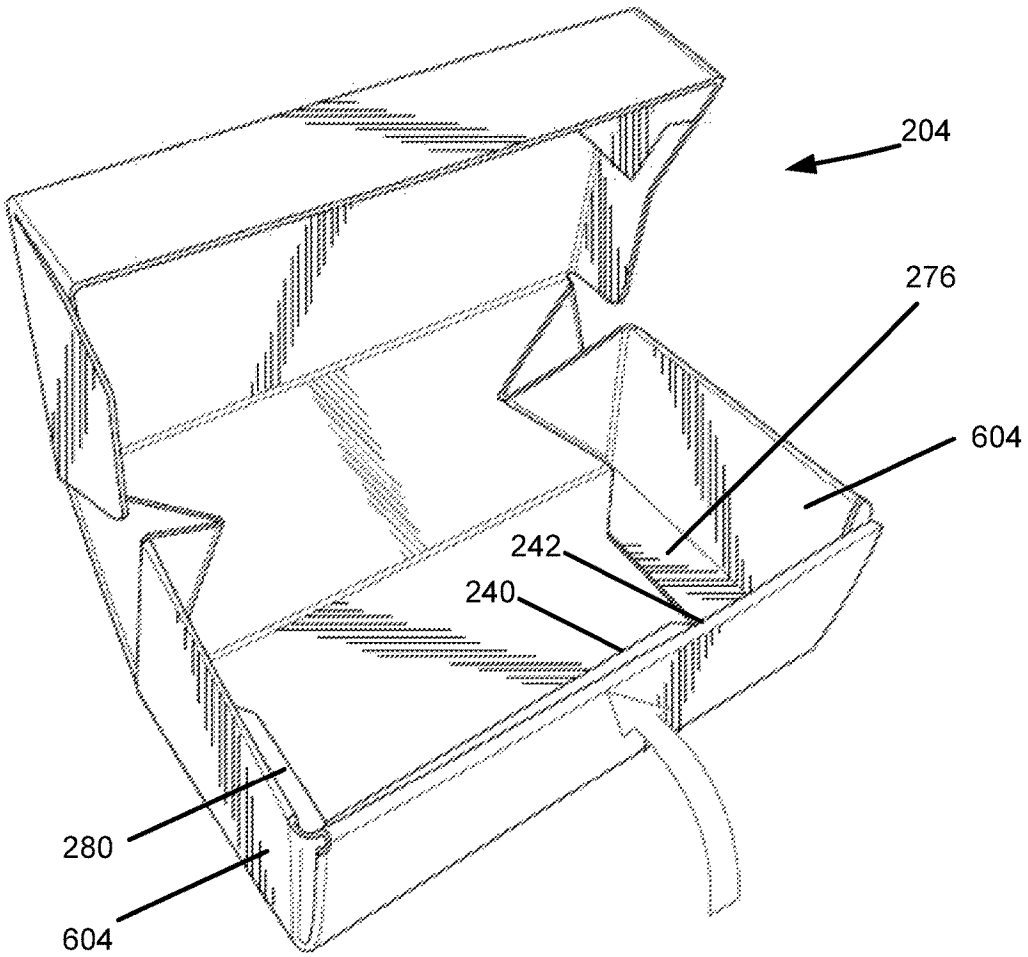

As shown in FIG. 21, in some examples, the front inside panel 242 may be folded about the line of weakness 212 between the outside front panel 244 and the inside front panel 242 to enable the flange 240 to engage the flanges 276, 280 of the left and right side panels 602, 604 to substantially prevent the inside front panel 242 from reverse folding when the gift box 204 is erected.

Figure 22:
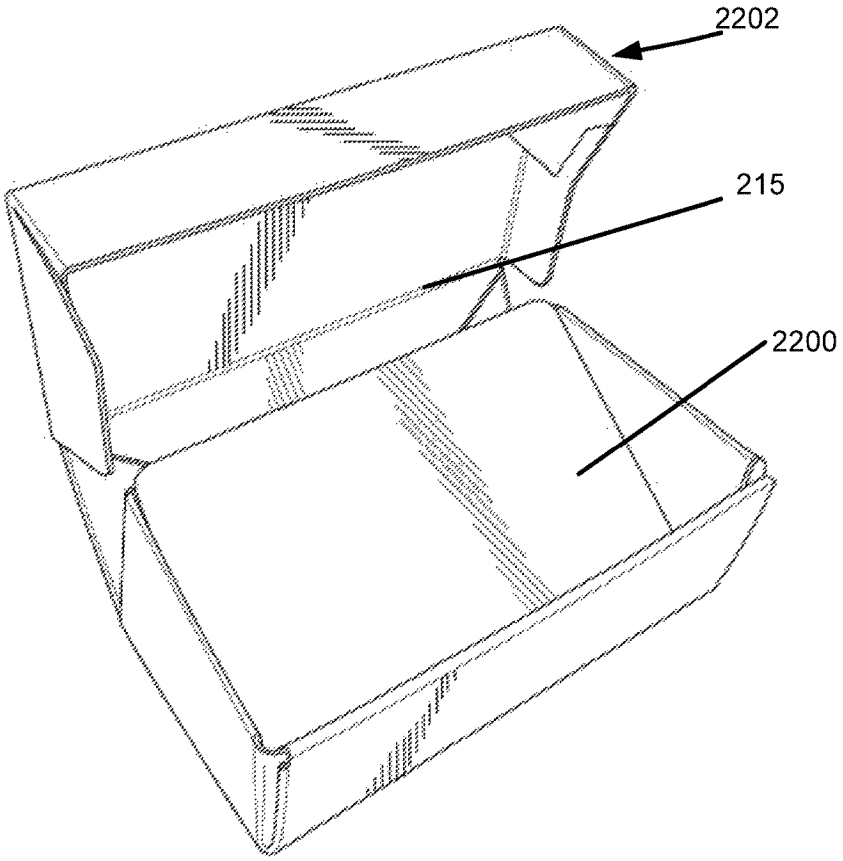
Figure 23:
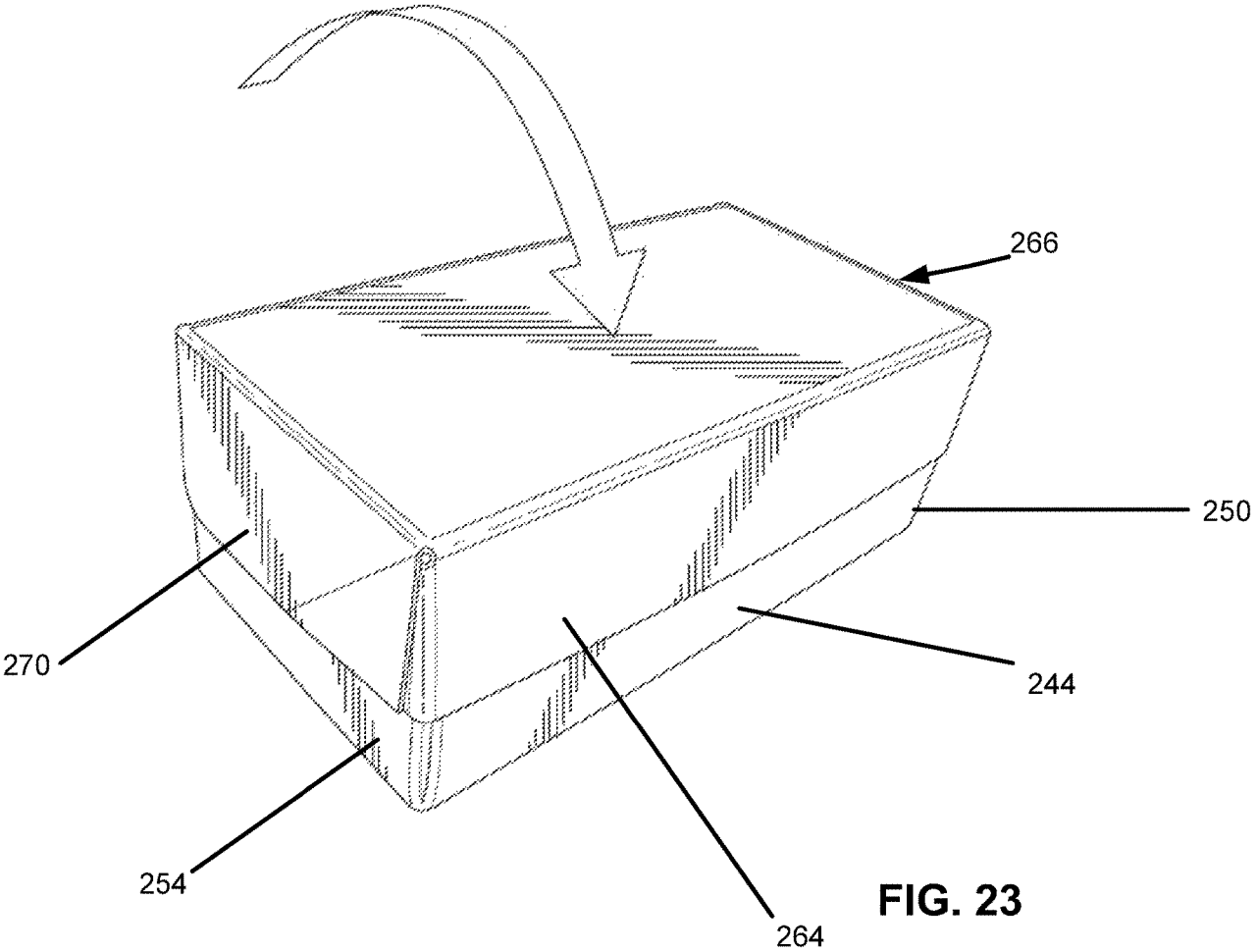

As shown in FIGS. 22 and 23, in some examples, a gift card 2200, which may have been removed from the backer 202, can be positioned within the gift box 204 and a lid 2202 may be folded about the line of weakness 215 such that the left and right lid side panels 266, 270 at least partially cover the outside left and right side panels 250, 254 and the front lid panel 264 at least partially covers the outside front panel 244.

Figure 24:
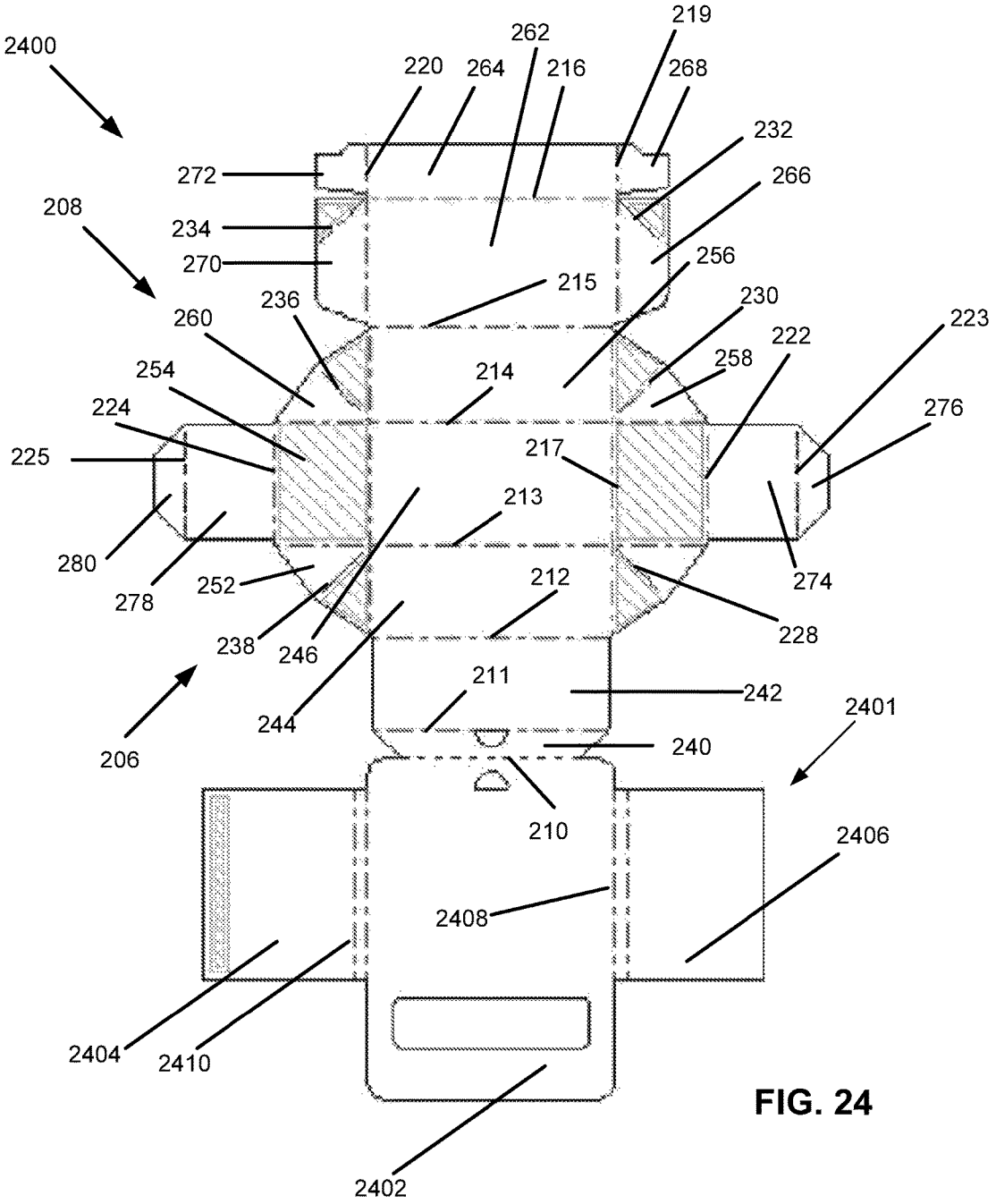
FIGS. 24-38 depict the fabrication of another example gift card apparatus in accordance with the teachings of this disclosure
Figure 25:
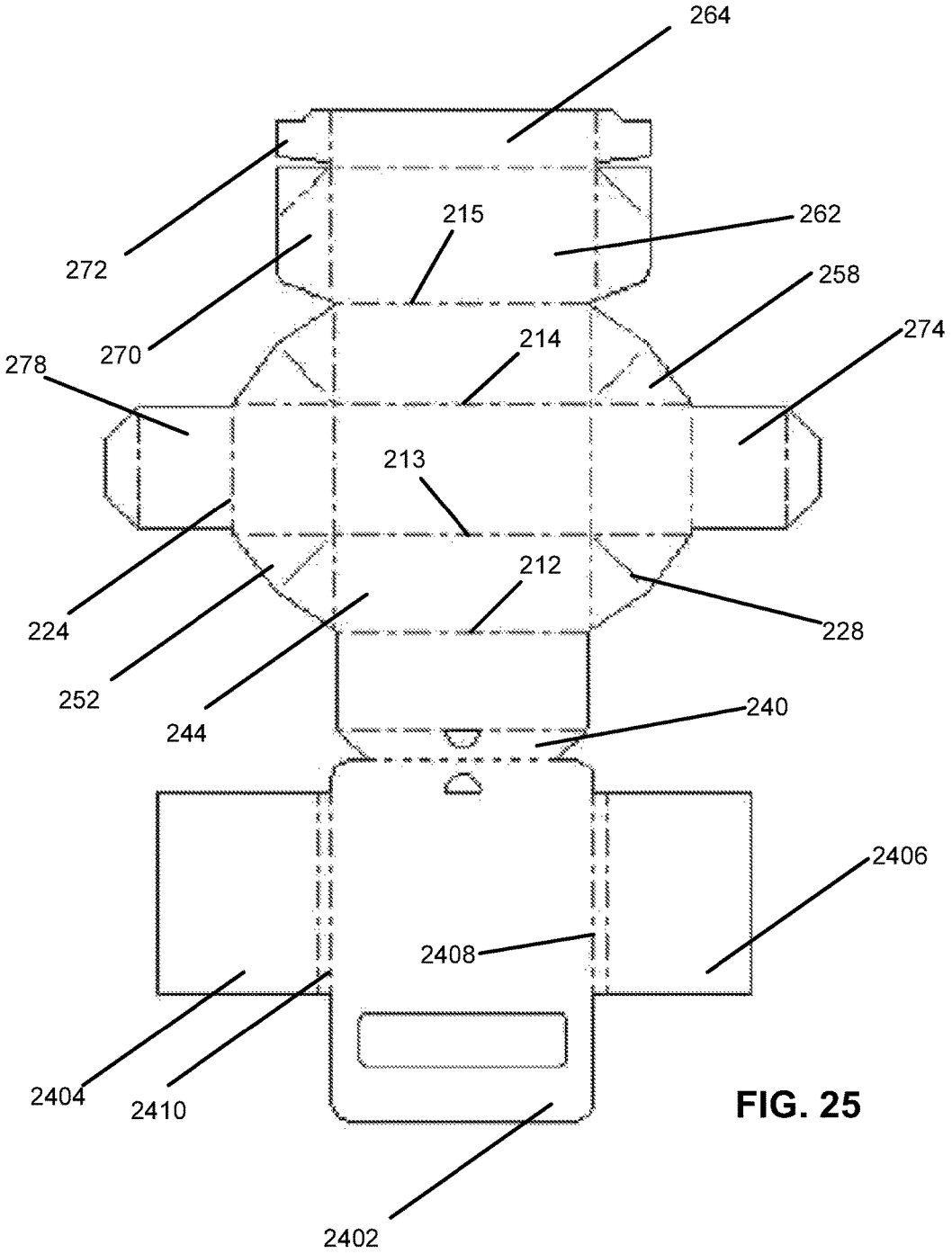

FIGS. 24 and 25 depict an example blank gift card apparatus 2400 in accordance with the teaching of this disclosure. In the illustrated example, the blank 2400 includes a backer card portion 2401 and the gift box portion 204 including the modified simplex tray 206 and the lid 208. In contrast to the blank gift card apparatus 200 described above, the example blank 2400 includes the example backer 2401 having a backer panel 2402, a left panel and/or flap 2404 and a right panel and/or flap 2406. In some examples, a fold line, a plurality of fold lines and/or lines of weakness 2408 couple the backer panel 2402 and the right panel 2406 and a fold line, a plurality of fold lines and/or lines of weakness 2410 couple the backer panel 2402 and the right panel 2406.

FIGS. 26-38 depict the process forming a gift card apparatus from the blank 2400 after the blank 2400 been imaged and/or the lines of weakness 210-238, 2408 and 2410 have been formed. In some examples, the blank 2200 has first and second opposing surfaces 400, 401. In some examples, the blank 2300 includes the backer 2401 and the gift box 204. The backer 202 may define the barcode cutout 402 and a hanger cutout 404. The gift box 204 may include the lid 208 and the modified simplex tray 206 defining the hanger cutout 406.

Figure 26:
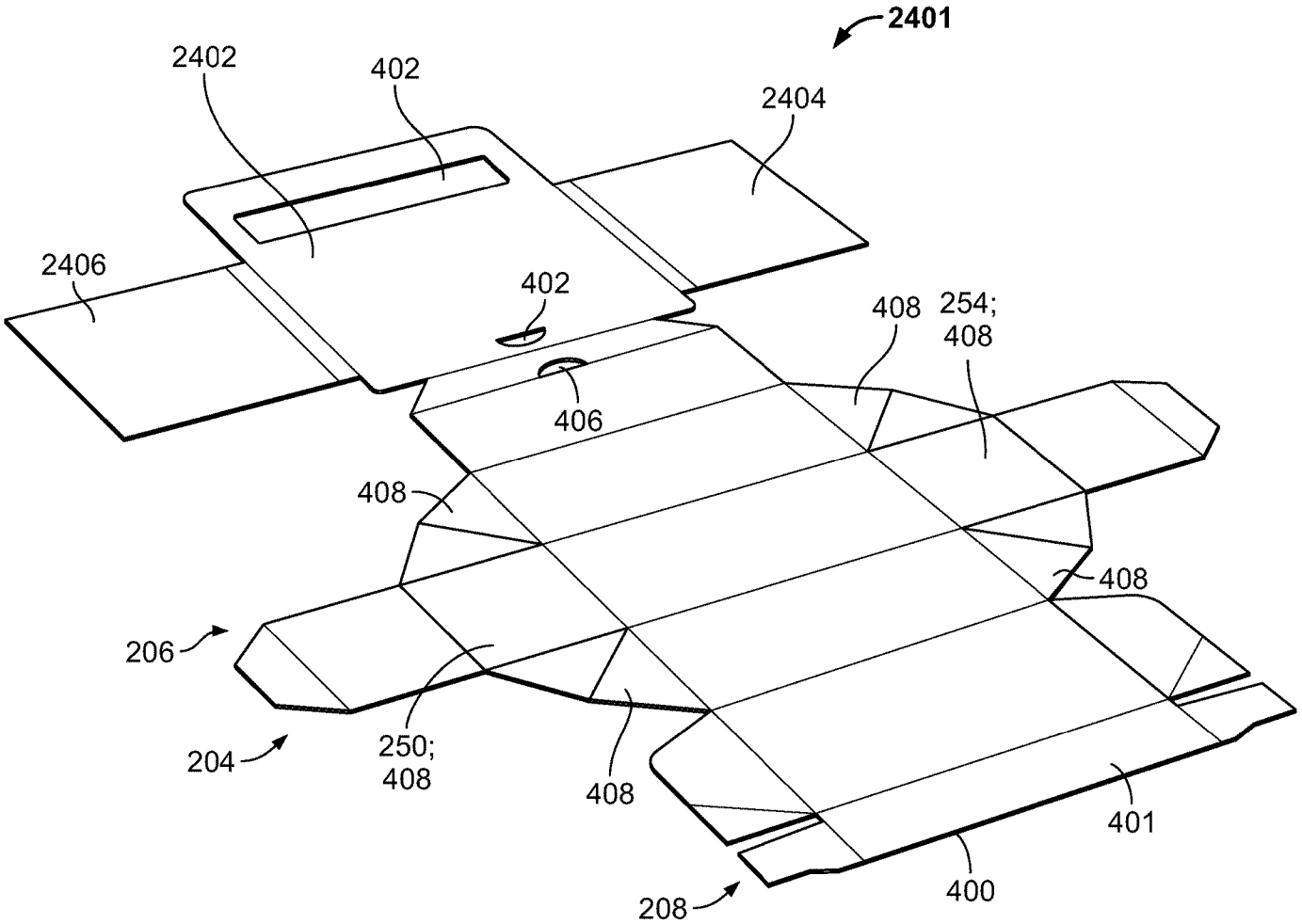
Figure 27:
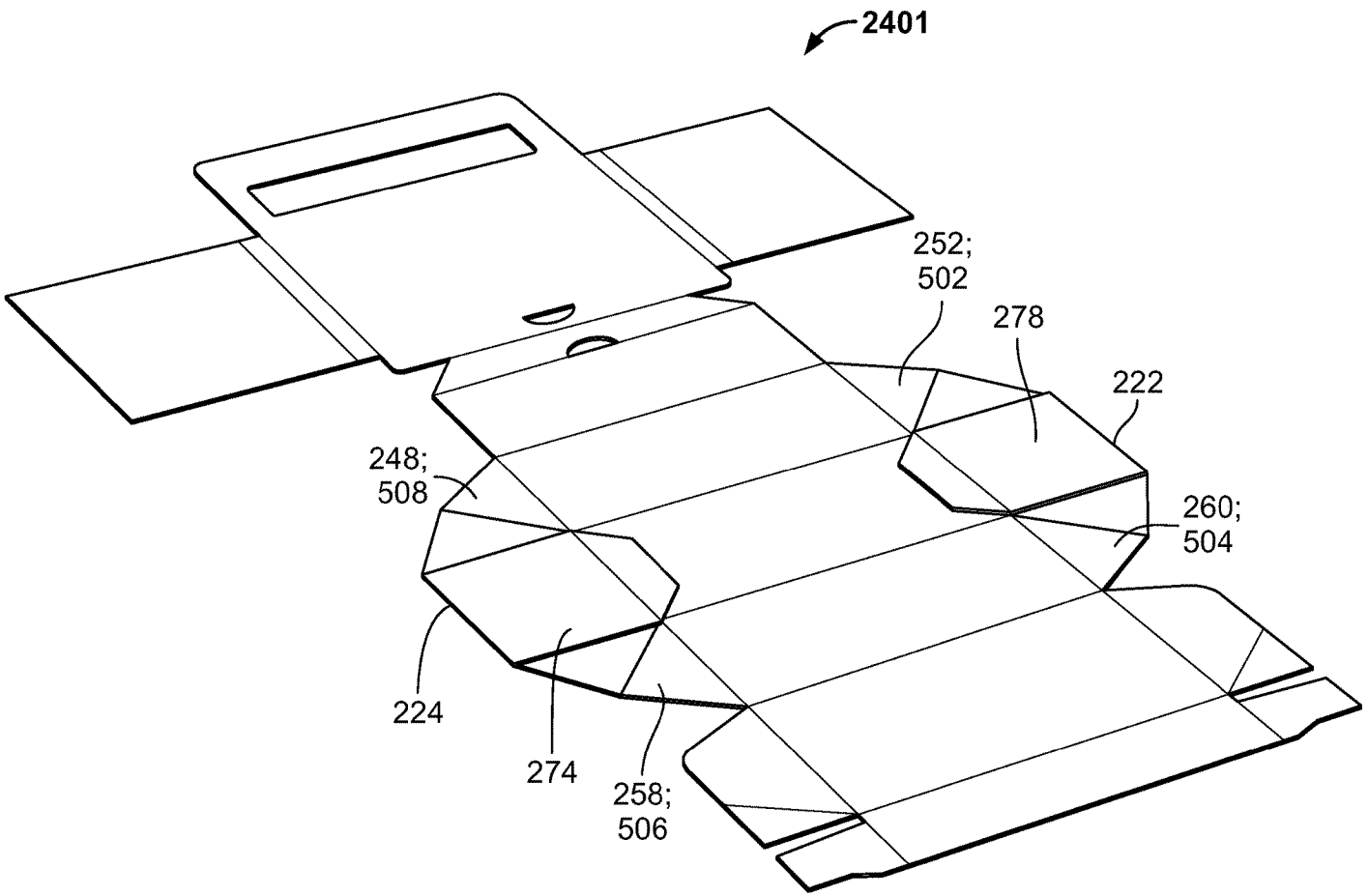

As shown in FIGS. 26 and 27, in some examples, to form the gift box 204, adhesive and/or glue 408 may be applied to the second surface 401 at the outer left and right side panels 250, 254 and side glue areas 502-508 of the bellow corners 248, 252, 258 and 260. The inner left and right side panels 274, 278 may be folded about the lines of weakness 222, 224 to couple the inner left side panel 278 to the outer left side panel 254 and the inner right side panel 274 to the outer right side panel 250.

Figure 28:
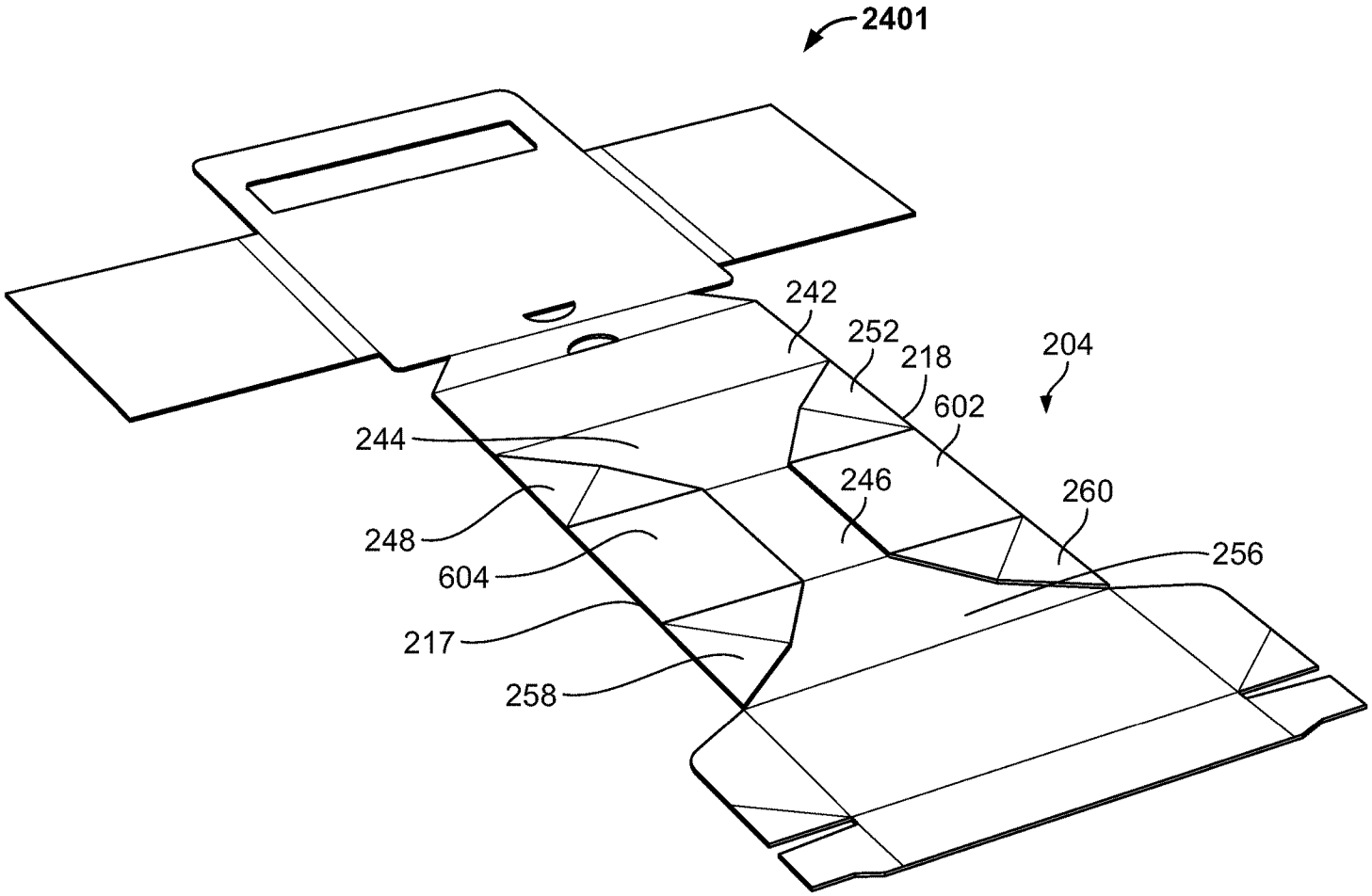

As shown in FIG. 28, to form a portion of the gift box 204, the bellow corners 248, 252, 258 and 260, the left panel 602 and the right panel 604 may be inwardly folded about the lines of weakness 217, 218 to couple the side glue areas 502-508 of the bellow corners 248, 252, 258 and 260 to the outside front panel 244 and/or the outside back panel 256. In some such examples, the flanges 276, 280 may be positioned adjacent the bottom panel 246 and may be used to secure and/or lock the inside front panel 242 when the gift box 204 is erected.

Figure 29:
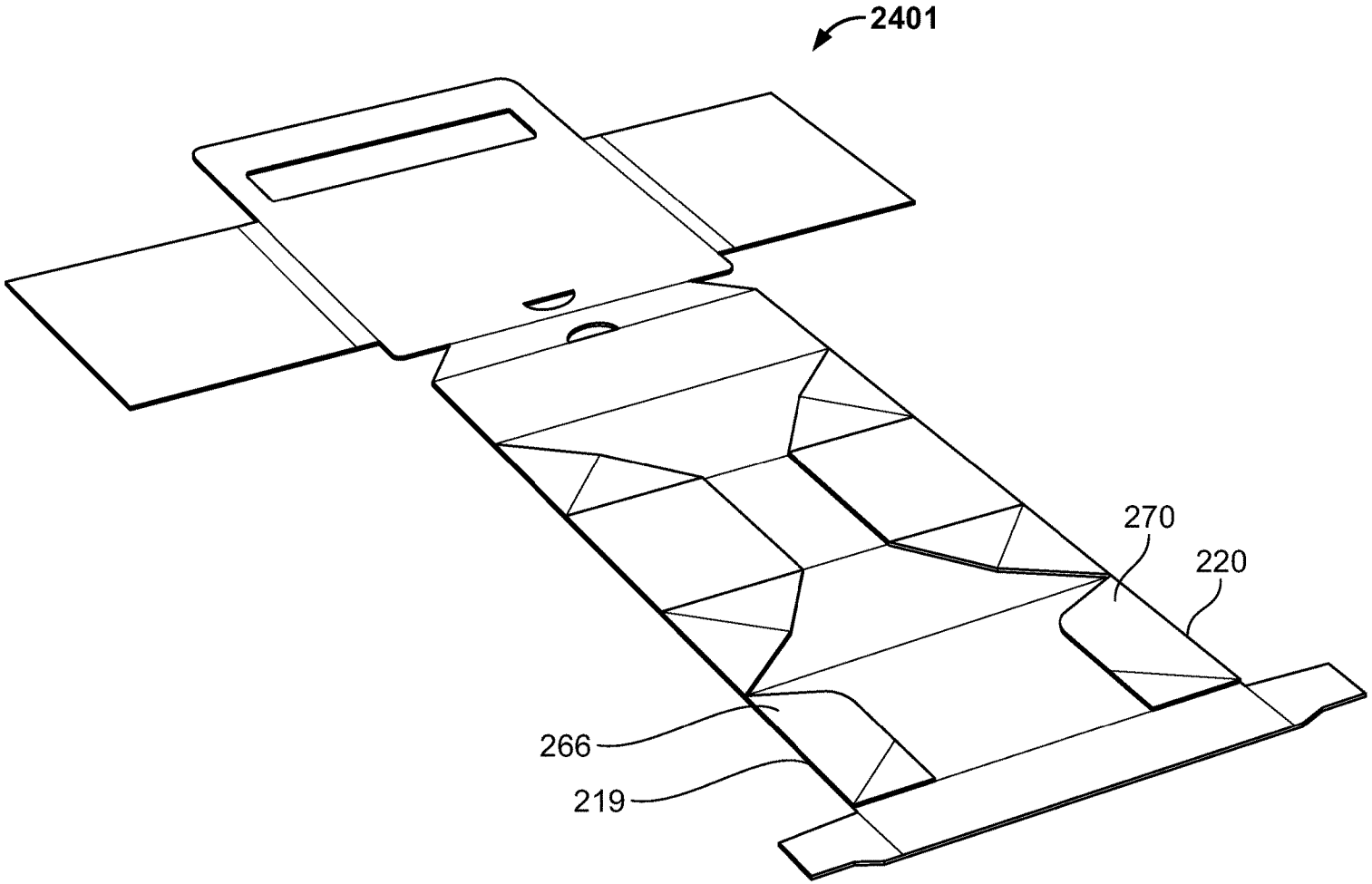
Figure 30:
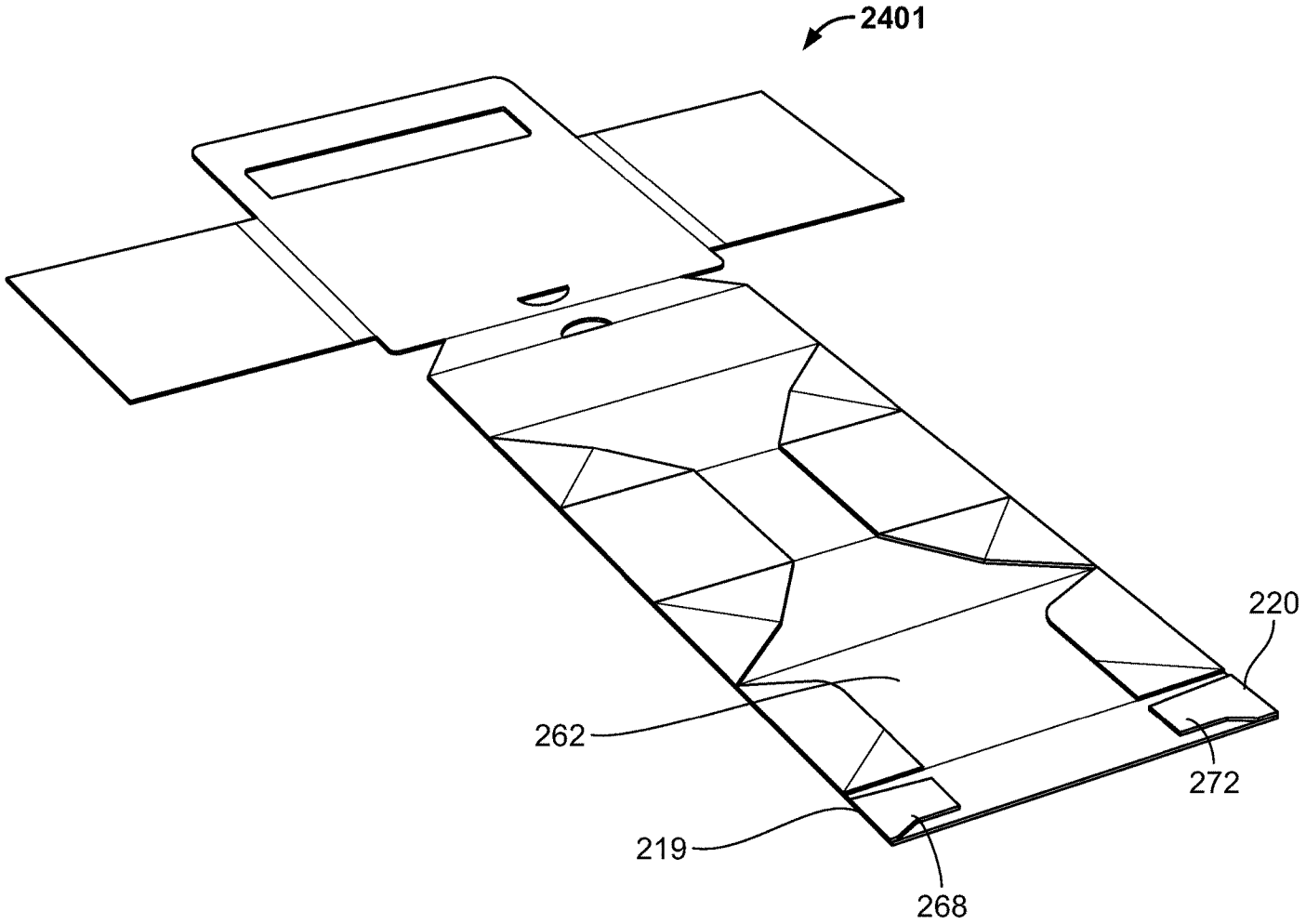
Figure 31:
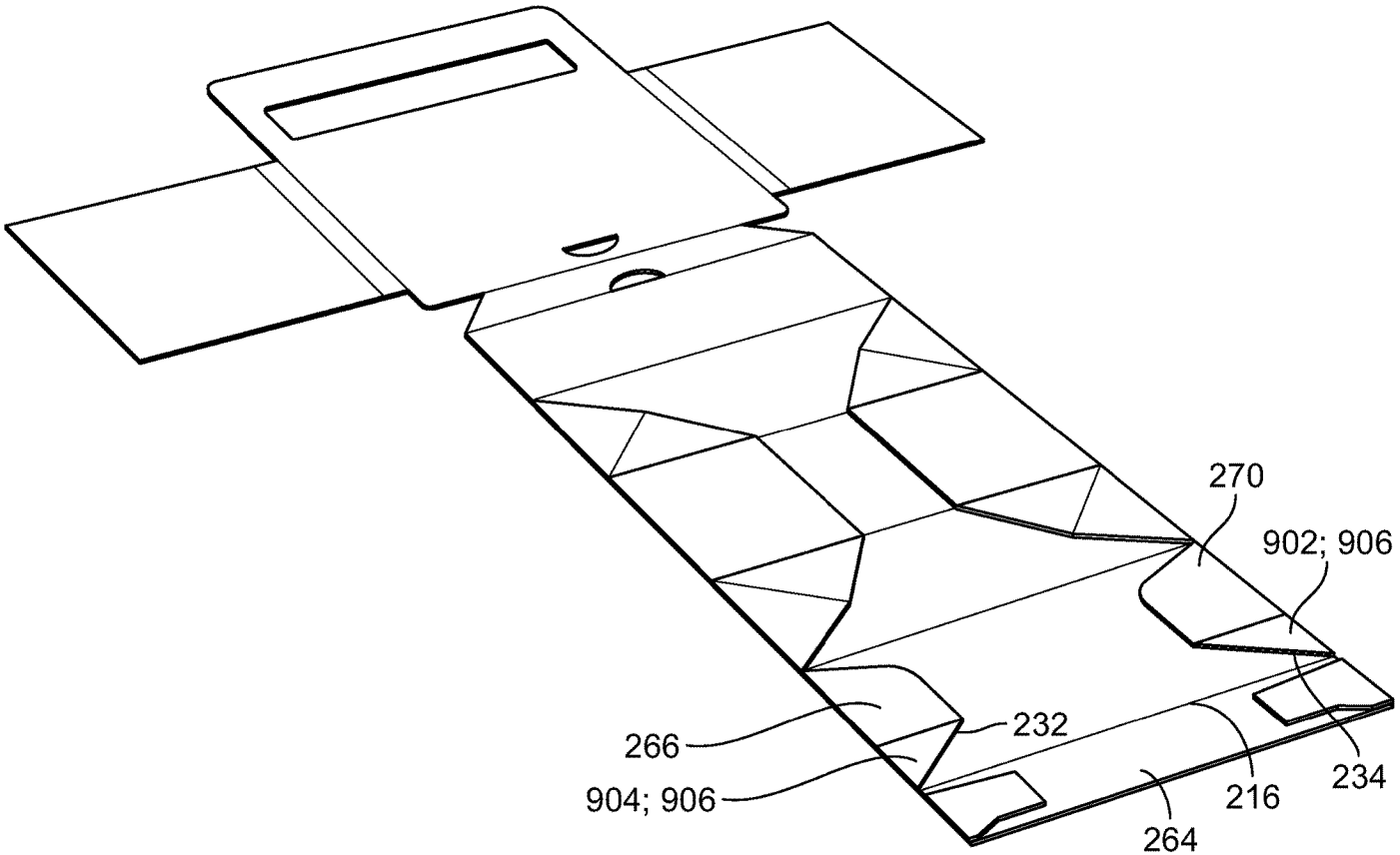
Figure 32:
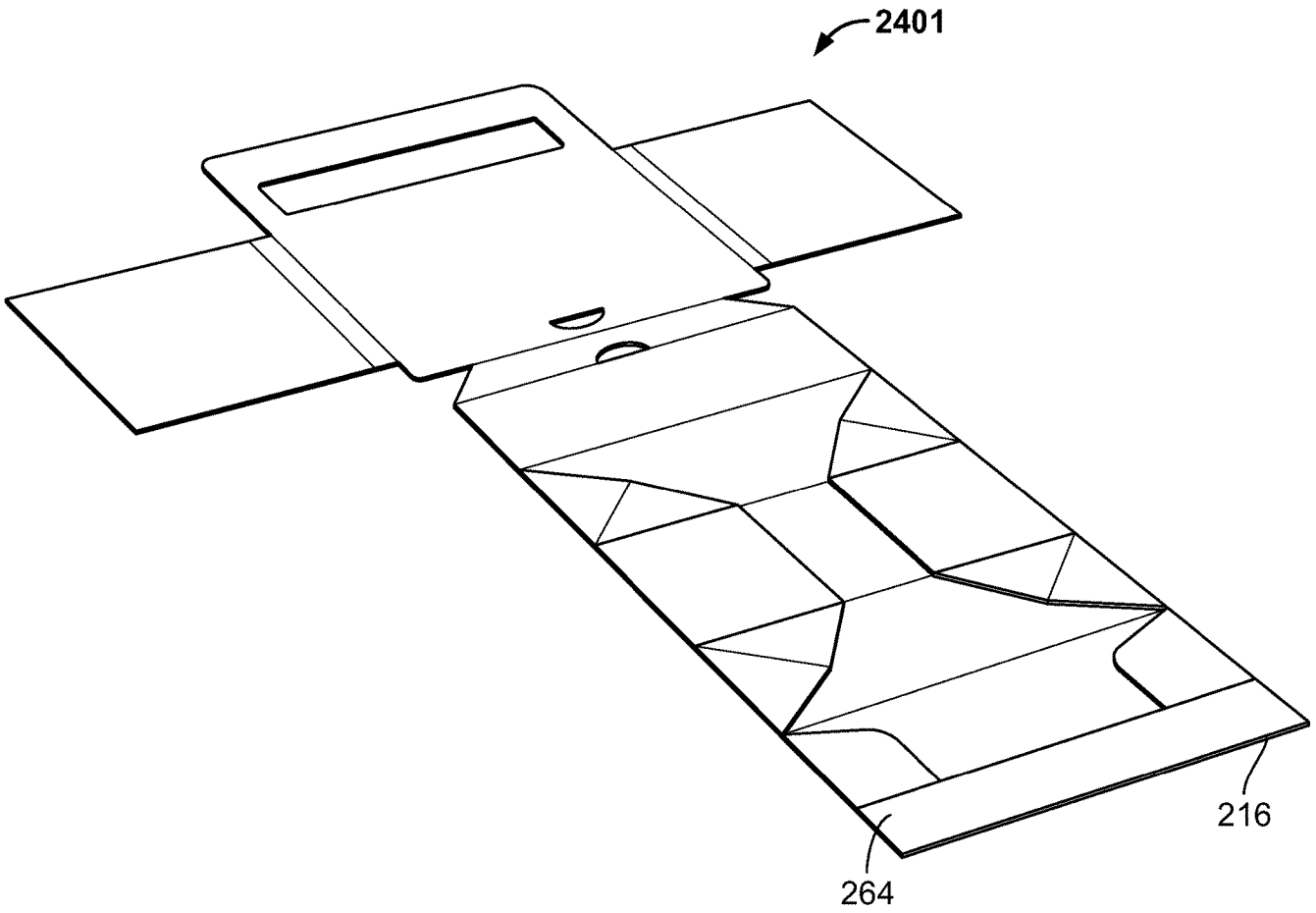

As shown in FIGS. 29 and 30, in some examples, to form a portion of the lid, the left and right lid side panels 266, 270 and the left and right lid flaps 268, 272 may be folded about the lines of weakness 219, 220. As shown in FIGS. 31 and 32, in some examples, the left and right lid glue areas 902, 904 of the left and right lid side panels 266, 270 may be reverse folded about the lines of weakness 232, 234. Adhesive and/or glue 906 may be applied to the left and right lid glue areas 902, 904 and the front lid panel 264 may be folded about the line of weakness 216 to couple the front lid panel 264 to the left and right lid glue areas 902, 904.

Figure 33:
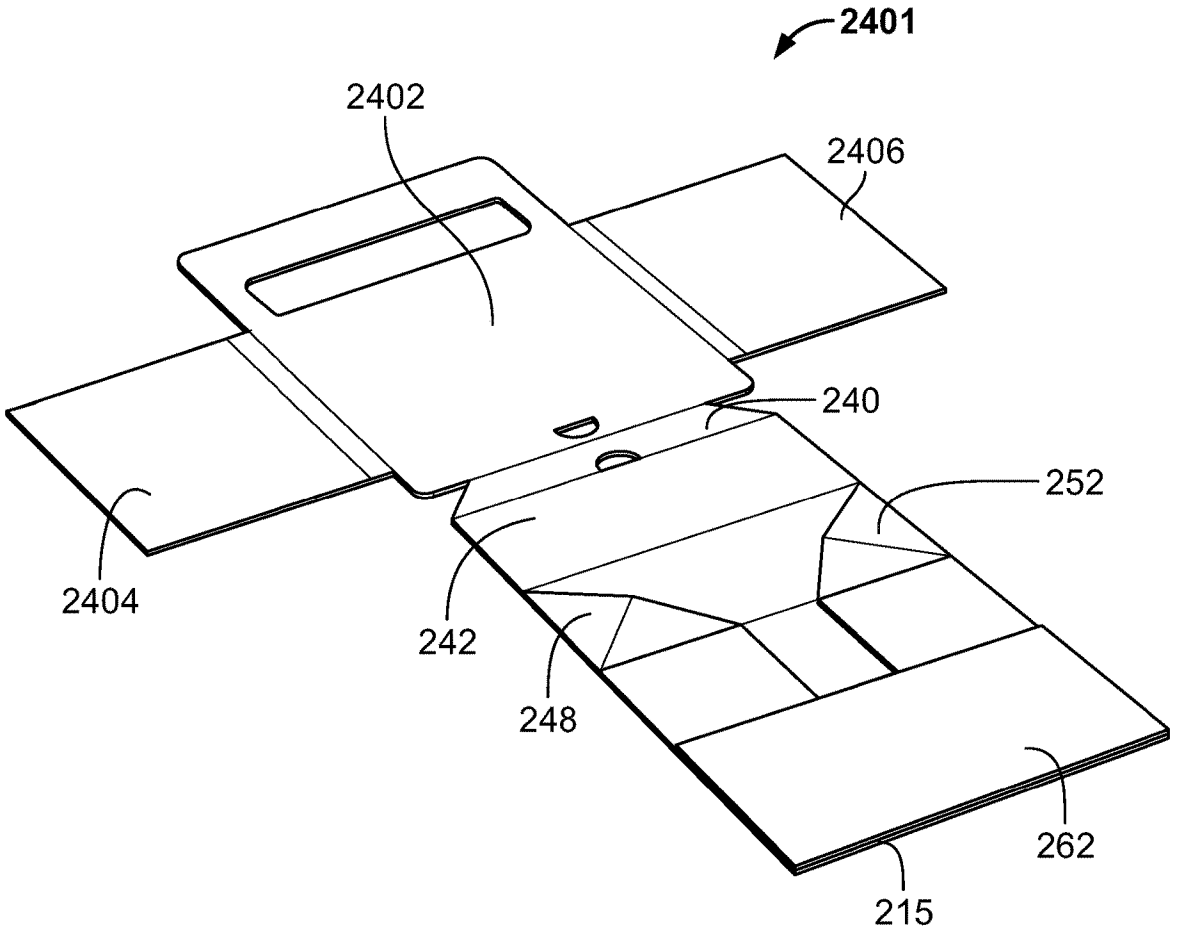
Figure 34:
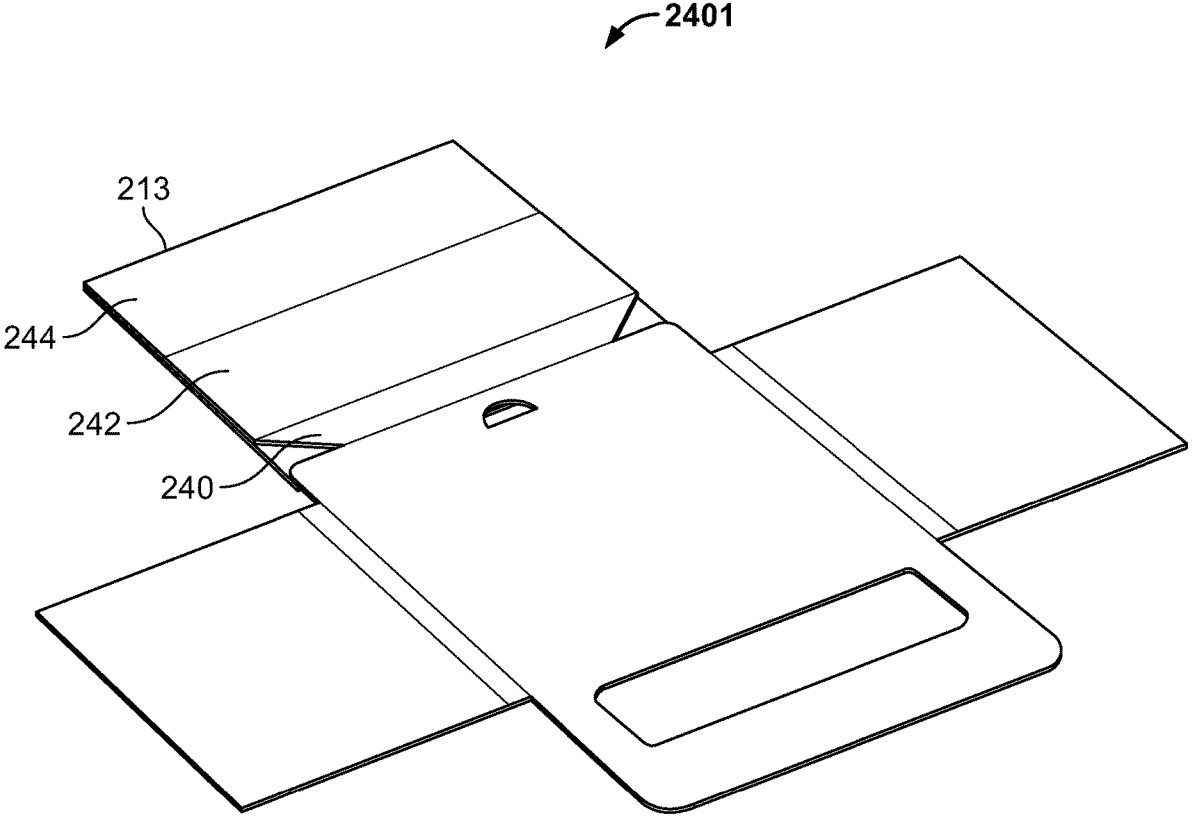
Figure 35:
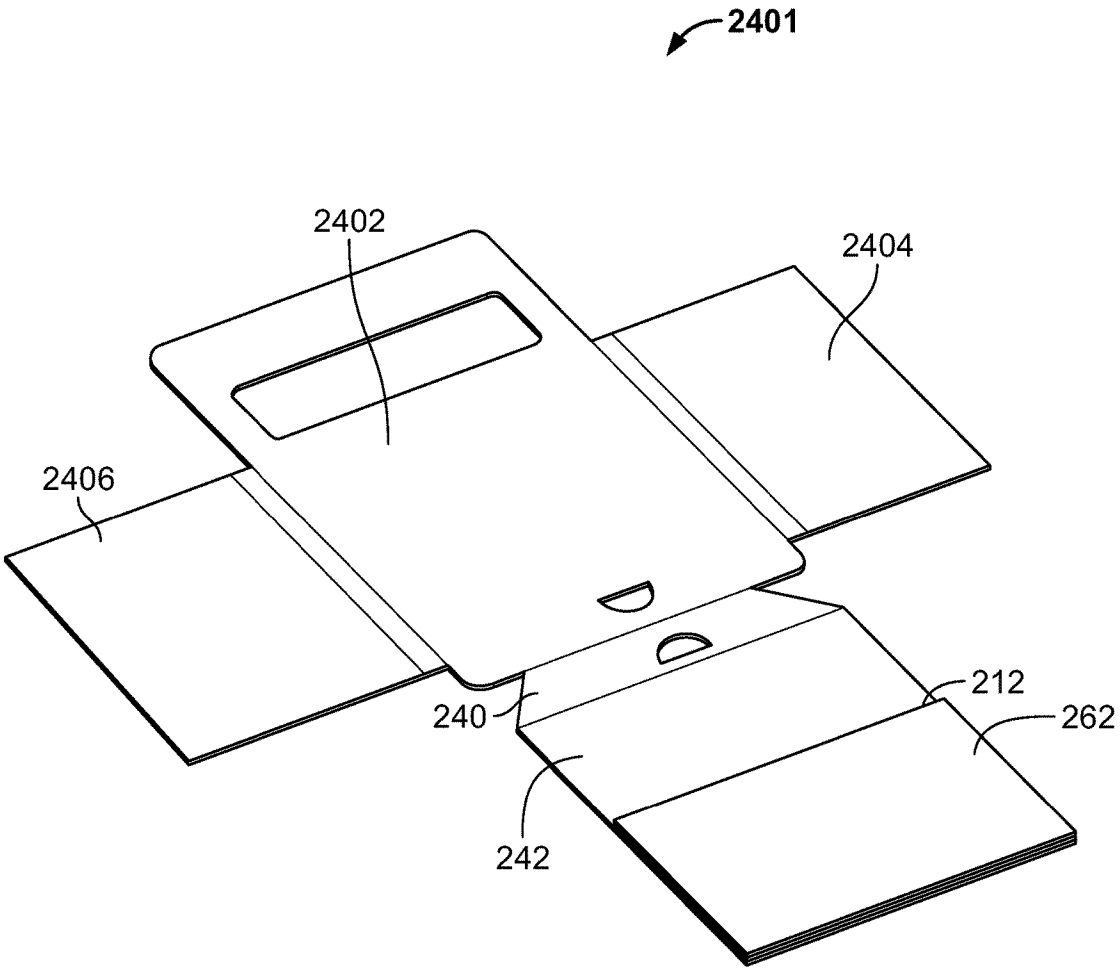

As shown in FIGS. 32 and 33, in some examples, the front lid panel 264 may be folded about the line of weakness 216 and the lid panel 262, the front lid panel 264, the left and right lid panels 266, 270 and the lid flaps 268 and 272 may be folded the line of weakness 215. In some examples, as shown in FIG. 34, the outside front panel 244, the inside front panel 242, the flange 240, the first and second bellow corners 248, 252 and the backer 202 may be folded about the line of weakness 213 between the outside front panel 244 and the bottom panel 246. As shown in FIG. 35, the inside front panel 242, the flange 240 and the backer 1401 may be reverse folded about the line of weakness 212 between the outside front panel 244 and the inside front panel 242.

Figure 36:
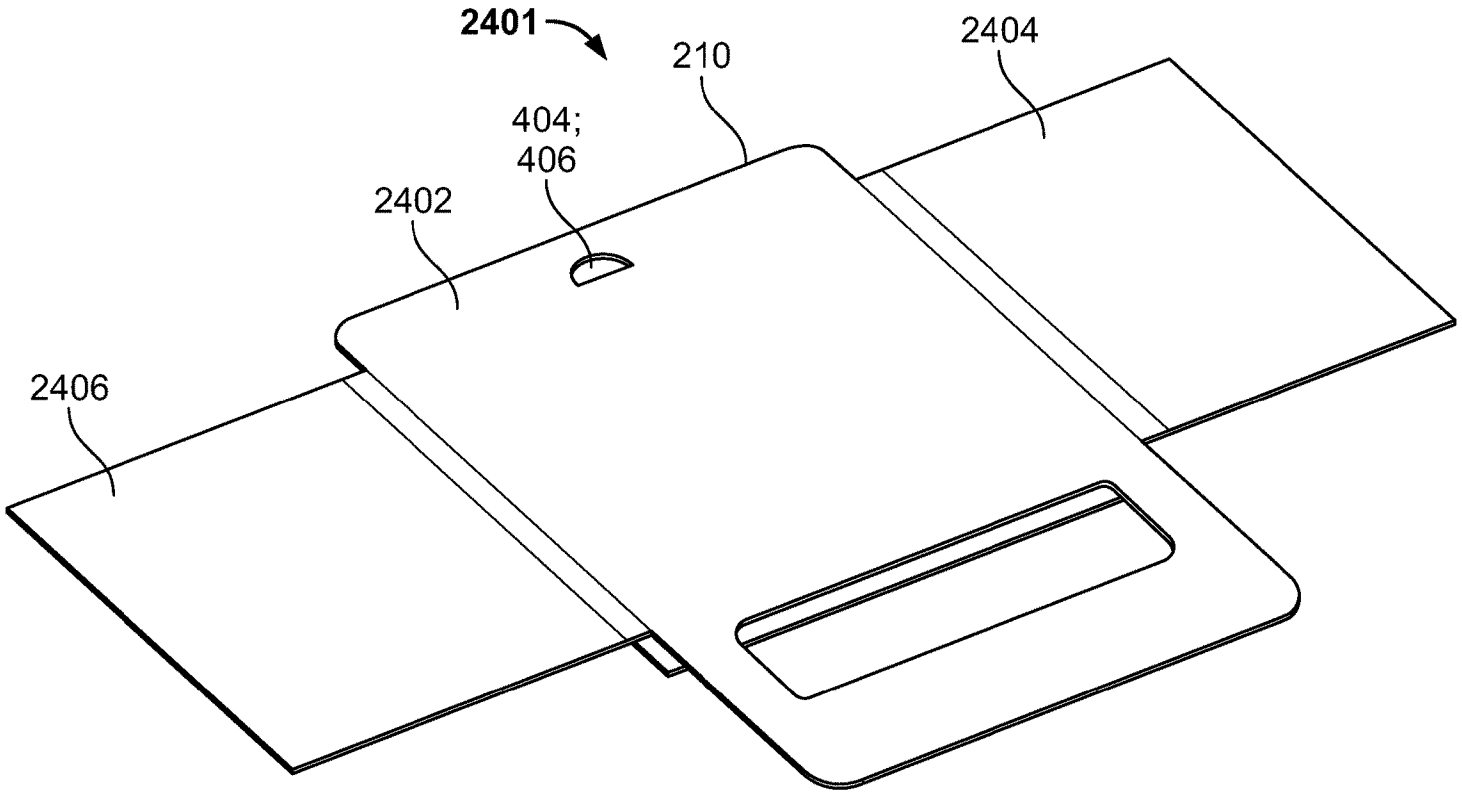
Figure 37:
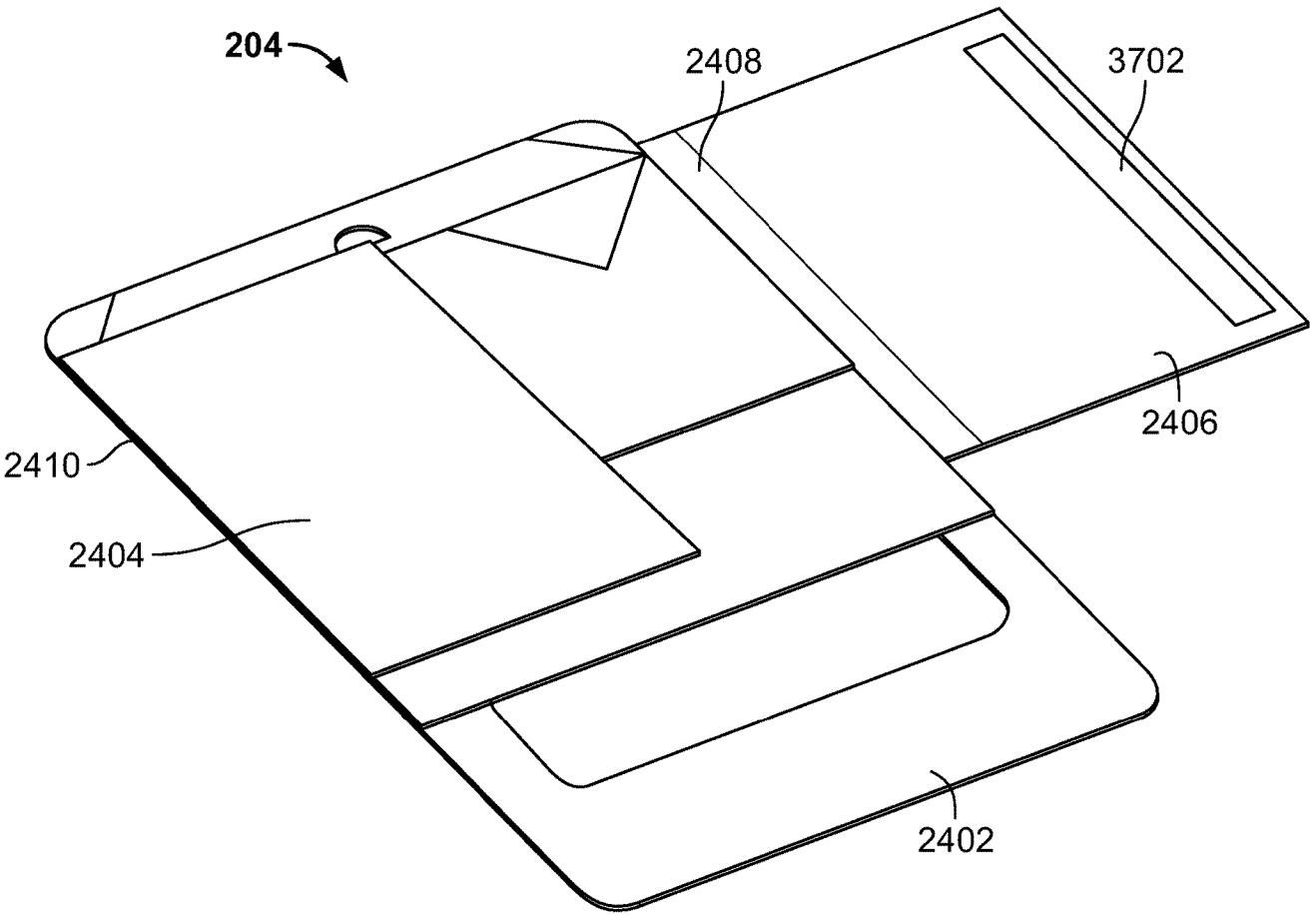
Figure 38:
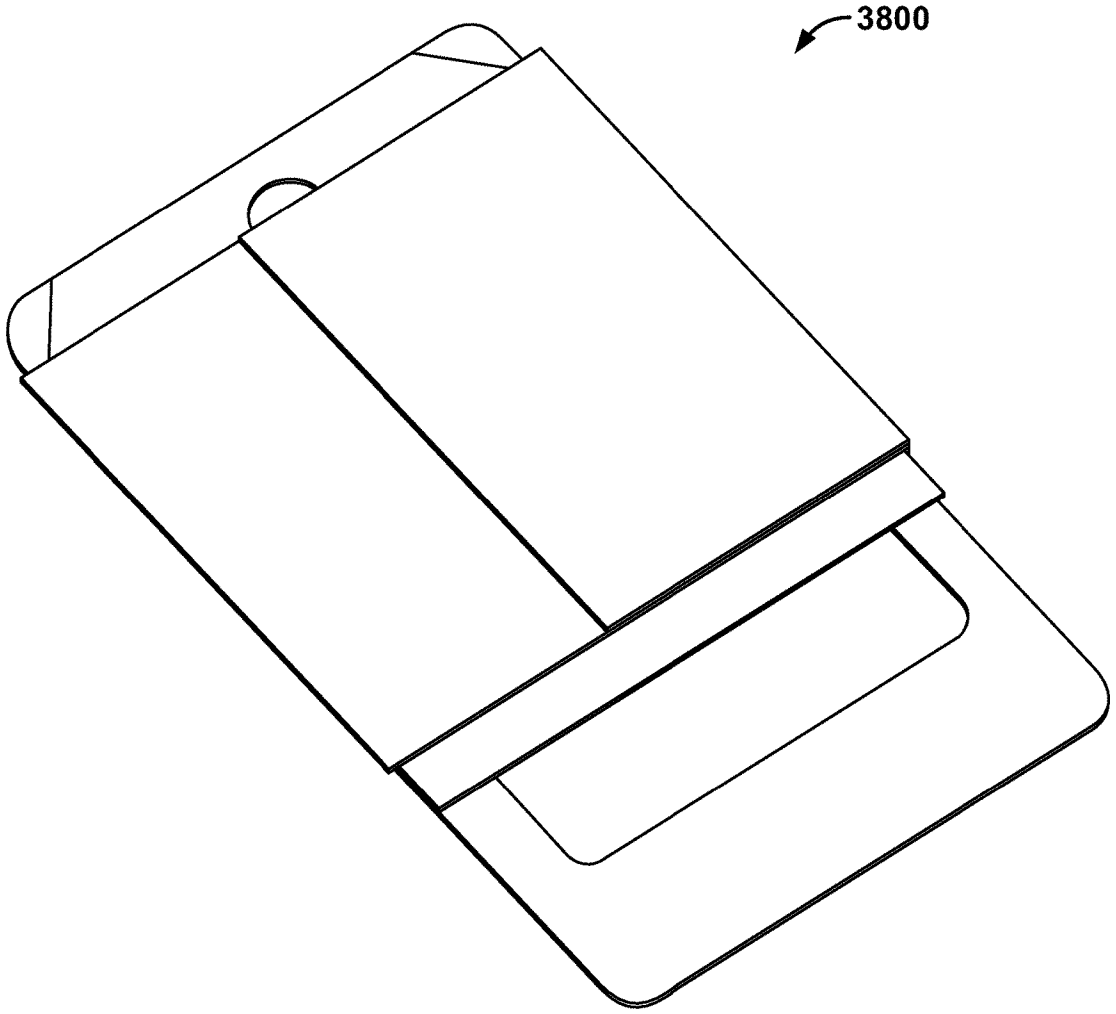

As shown in FIGS. 36-38, in examples in which the backer 2401 includes the left or right panels 2404, 2406, to couple the backer 2401 to the gift box 204 and/or ready the gift card apparatus to be hung for retail sale and/or to have a gift card affixed thereto, the backer 2401 is folded about the line of weakness 210 to align the hanger cutouts 404, 406 of the backer 2401 and the gift box 204. As shown in FIGS. 37 and 38, an adhesive and/or glue 3702 may be applied to the right panel 2406 and the left and right panels 2404, 2406 of the backer 2401 are folded about the lines of weakness 2408, 2410 to at least partially surround the broken down gift box 204 and couple the left and right panels 2404, 2406 together and form a gift card apparatus 3800. In some examples, the lines of weakness 2408 and 2410 are double lines of weakness to enable the gift box 204 to be positioned within the panels 2404, 2406 without substantially outwardly bowing the panels 2404, 2408.

Figure 39:
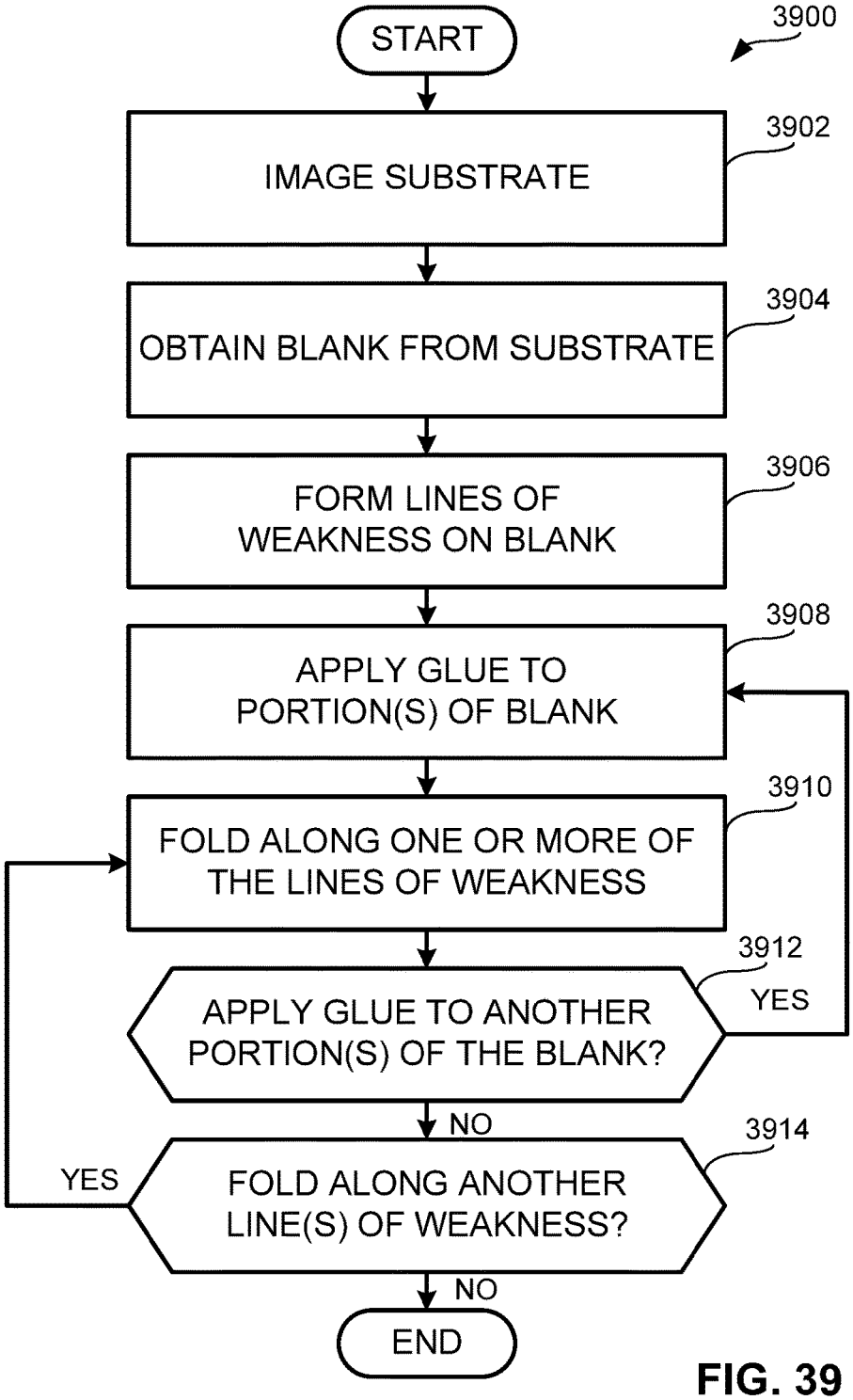
FIG. 39 is a flowchart representation of example machine readable instructions that may be implemented to produce the example gift card apparatus of FIGS. 2-38.

FIG. 39 depicts an example flow diagram representative of processes that may be implemented using, for example, computer readable instructions that may be carried out in conjunction with paper processing equipment such as die cutters, web presses, etc. to produce the example gift card apparatus disclosed herein and/or any other of the examples disclosed herein. The example processes of FIG. 39 may be performed using a processor, a controller and/or any other suitable processing device. For example, the example processes of FIG. 39 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIG. 39 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example processes of FIG. 39 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIG. 39 may be implemented manually or as any combination(s) of any of the foregoing techniques, for example, any combination of firmware, software, discrete logic and/or hardware. Further, although the example processes of FIG. 39 are described with reference to the flow diagram of FIG. 39, other methods of implementing the processes of FIG. 39 may be employed. For example, the order of execution of the blocks may be changed, and/or some of the blocks described may be changed, eliminated, sub-divided, or combined. Additionally, any or all of the example processes of FIG. 39 may be performed sequentially and/or in parallel by, for example, separate processing threads, processors, devices, discrete logic, circuits, etc.

FIG. 39 represents an example method 3900 of producing the examples disclosed herein. While the processes of the method 3900 are depicted as being performed sequentially, one or more of the processes may be performed in parallel, for example. The process may begin by unwinding a substrate from a roll and/or moving one or more pieces of substrate toward an imager (block 3902). In some examples, the imager images a first and/or a second side of the substrate. The images may include brand-related images and/or text, instructional images and/or text, etc. A blank may be obtained from the substrate and lines of weakness may be formed on the blank (blocks 3904, 3906). In some examples, the blank is obtained by die-cutting the substrate. In some examples, the lines of weakness are formed using a die(s), a cutting tool(s), a scoring tool(s), a slotting tool(s), etc. Glue may be applied to one or more portions of the blank and the blank may be folded along one or more lines of weakness (block 3908, 3910). For example, glue may be applied to outside left and right panels, portions of the bellows. For example, the inside left panel may be folded relative to the outside left panel and/or the inside right panel may be folded relative to the outside right panel. It may then be determined whether or not to apply glue to another portion(s) of the blank and/or to fold along another line(s) of weakness (blocks 3912, 3914). For example, glue may be applied to the left and right lid glue areas and/or backer may be folded relative to the gift box.

An example gift card apparatus includes a gift card backer coupled to a gift box assembly via a line weakness. In some examples, the line of weakness is a perforation. In some examples, the gift card apparatus includes a gift card coupled to the gift card backer. In some examples, the gift box includes a plurality of lines of weakness. In some examples, the one or more of the lines of weakness are parallel, perpendicular, in line with and/or offset from one or more other lines of weakness. In some examples, the gift box includes a lid and a modified simplex tray. In some examples, the lid is hingably coupled to the modified simplex tray. In some examples, the gift box and/or the gift card backer defines a hanger cutout.

An example method of producing a gift card apparatus includes obtaining a blank and creating one or more lines of weakness on the blank. The method includes applying adhesive to one or more portions of the blank and/or folding the blank along one or more of the lines of weakness to enable a gift box to be formed. In some examples, the gift box includes a lid and a modified simplex tray. In some examples, the lid is hingably coupled to the modified simplex tray.

As set forth herein an example apparatus includes a substrate having a first panel and a self-erecting box having a lid. A first line of weakness is defined by the substrate to separate the first panel from the self-erecting box. The first panel to be folded about the first line of weakness to position a first surface of the first panel immediately adjacent the self-erecting box. A card to be coupled to a second side of the panel.

Another example apparatus includes a substrate having a first panel and a self-erecting box having a lid. A first line of weakness is defined by the substrate to separate the first panel from the self-erecting box. The first panel is to be folded about the first line of weakness to position a first surface of the first panel immediately adjacent the self-erecting box.

In some examples, the apparatus includes adhesive between the first panel and the self-erecting box to couple the first panel and the self-erecting box. In some examples, the apparatus includes indicia on at least of one of the first panel or the self-erecting box associated with an instruction to erect the self-erecting box. In some examples, the first panel defines a window to enable a portion of the card to be visible therethrough. In some examples, the first panel defines an aperture to enable the first substrate to be hung from a display hook. In some examples, the self-erecting box is a 6-corner beer tray. In some examples, the self-erecting box is a 4-corner beer tray having a lid. In some examples, the first panel and the self-erecting box define respective apertures that align when the first panel is folded about the first line of weakness. The aligned apertures enable the first substrate to be hung from a display hook.

In some examples, the substrate includes a first side panel and a second side panel. The first side panel is coupled to the first panel at a second line of weakness and the second side panel is coupled to the first panel at a third line of weakness. The second and third lines of weakness are substantially perpendicular to the first line of weakness.

In some examples, when the first side panel is folded about the first line of weakness, the first and second side panels are to be folded about the second and third lines of weakness to secure the self-erecting box to the first panel and to position the self-erecting box between the first panel and the second and third panels.

In some examples, the apparatus includes adhesive between the second and third panels to couple the second and third panels when the self-erecting box is positioned between the first panel and the second and third panels. In some examples, the first line of weakness is a perforation.

Another example apparatus includes a first panel formed from a substrate. The apparatus includes a self-erecting box having a lid. The self-erecting box formed from the substrate. The apparatus includes a first line of weakness defined by the substrate to separate the first panel from the self-erecting box. The first panel is to be folded about the first line of weakness to position a first surface of the first panel immediately adjacent the self-erecting box. In some examples, the apparatus also includes a card coupled to a second side of the first panel.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

The invention claimed is:

1. An apparatus, comprising:

a substrate including a first panel and a self-erecting box having a lid, a first line of weakness defined by the substrate to separate the first panel from the self-erecting box, the first panel to be folded about the first line of weakness to position a first surface of the first panel immediately adjacent the self-erecting box, prior to folding, the substrate is symmetric along a longitudinal axis of the substrate, wherein the substrate further includes a first side panel and a second side panel, the first side panel coupled to the first panel at a second line of weakness and the second side panel coupled to the first panel at a third line of weakness, the second and third lines of weakness being substantially perpendicular to the first line of weakness;

a card to be coupled to a second side of the first panel, wherein, when the first panel is folded about the first line of weakness, the first and second side panels are to be folded about the second and third lines of weakness to secure the self-erecting box to the first panel and to position the self-erecting box between the first panel and the first and second side panels; and adhesive between the first and second side panels to couple the first and second panels when the self-erecting box is positioned between the first panel and the first and second side panels.

2. The apparatus of claim 1, further including adhesive between the first panel and the self-erecting box to couple the first panel and the self-erecting box.

3. The apparatus of claim 1, further including indicia on at least of one of the first panel or the self-erecting box associated with an instruction to erect the self-erecting box.

4. The apparatus of claim 1, wherein the first panel defines a window to enable a portion of the card to be visible therethrough.

5. The apparatus of claim 1, wherein the first panel defines an aperture to enable the first substrate to be hung from a display hook.

6. The apparatus of claim 1, wherein the self-erecting box includes a 6-corner beer tray.

7. The apparatus of claim 1, wherein the self-erecting box includes a 4-corner beer tray having a lid.

8. The apparatus of claim 1, wherein the first panel and the self-erecting box define respective apertures that align when the first panel is folded about the first line of weakness, the aligned apertures to enable the first substrate to be hung from a display hook, the apertures to be positioned on opposing sides of the first line of weakness.

9. The apparatus of claim 1, wherein the first line of weakness includes a perforation.

* * * * *